US007297215B2

(12) United States Patent
Kurose et al.

(10) Patent No.: US 7,297,215 B2
(45) Date of Patent: Nov. 20, 2007

(54) COPPER BASE ALLOY, AND CAST INGOT AND PARTS TO BE CONTACTED WITH LIQUID

(75) Inventors: Kazuhito Kurose, Yamanashi (JP); Yukihiro Hirata, Yamanashi (JP); Tomoyuki Ozasa, Yamanashi (JP); Hisanori Terui, Yamanashi (JP)

(73) Assignee: Kitz Corporation, Chiba (JP)

( * ) Notice: Subject to any disclaimer, the term of this patent is extended or adjusted under 35 U.S.C. 154(b) by 0 days.

(21) Appl. No.: 10/527,217

(22) PCT Filed: Sep. 9, 2003

(86) PCT No.: PCT/JP03/11492

§ 371 (c)(1),
(2), (4) Date: Mar. 9, 2005

(87) PCT Pub. No.: WO2004/022804

PCT Pub. Date: Mar. 18, 2004

(65) Prior Publication Data

US 2006/0005901 A1 Jan. 12, 2006

(30) Foreign Application Priority Data

Sep. 9, 2002 (JP) ..... 2002-262677
Mar. 28, 2003 (JP) ..... 2003-092217

(51) Int. Cl.
*C22C 9/02* (2006.01)
*C22C 9/04* (2006.01)

(52) U.S. Cl. ..... 148/433; 420/470; 420/471; 420/472; 420/473

(58) Field of Classification Search ..... 148/433; 420/470–473

See application file for complete search history.

(56) References Cited

U.S. PATENT DOCUMENTS 5,487,867 A * 1/1996 Singh ..... 420/471
6,413,330 B1 * 7/2002 Oishi ..... 148/434
6,419,766 B1 7/2002 Ikemiya et al.

FOREIGN PATENT DOCUMENTS

JP 5-279771 10/1993

(Continued)

OTHER PUBLICATIONS

Report on Development of the Lead-Free Copper Alloy Casting, The Materials Process Technolgoy Center, Research Report 567 (ISSN 1342-565X), Feb. 28, 2002.

*Primary Examiner*—Sikyin Ip
(74) *Attorney, Agent, or Firm*—Wenderoth, Lind & Ponack, L.L.P.

(57) ABSTRACT

By exactly comprehending the true properties of the rare elements (such as Bi and Se) which are alternative components for Pb, the alloy is enabled to secure machinability equal to the bronze alloy (CAC406) generally used hitherto and acquire mechanical properties at least equal to the CAC406 as well in spite of a decrease in the content of the rare elements (such as Bi and Se) in the alloy. Further, it is possible to suppress the occurrence of casting defects by elucidating the unresolved influence of the decrease of the alternative components (such as Bi and Se) for Pb on the wholesomeness of a casting. Moreover, it is possible, by decreasing the rare elements, to produce a copper-based alloy containing rare elements at a low cost and to provide a cast ingot and a liquid-contacting part each using the alloy. The copper-based alloy, and the cast ingot and liquid-contacting part each using the alloy individually contain at least 2.8 to 5.0 wt % of Sn, 0.4 to 3.0 wt % of Bi and satisfying $0<Se\leqq 0.35$ wt % to enable securing prescribed machinability and wholesomeness of a casting and exalt mechanical properties thereof.

13 Claims, 13 Drawing Sheets

FOREIGN PATENT DOCUMENTS

| | | | |
|---|---|---|---|
| JP | 11-36026 | | 2/1999 |
| JP | 2000-129375 | * | 5/2000 |
| JP | 2000-336442 | | 12/2000 |
| JP | 2002-88427 | | 3/2002 |
| JP | 2003-193157 | | 7/2003 |

* cited by examiner

Top plan view

Side elevational view

No. 1

No. 2

No. 3

No. 4

No. 5

No. 6

No. 7

No. 8

No. 9

No. 10

No. 11

No. 12

No. 13

No. 14

Relation between Bi content and amount of Bi phase precipitation

Relation between Se content and amount of Se-Zn phase precipitation

COPPER BASE ALLOY, AND CAST INGOT AND PARTS TO BE CONTACTED WITH LIQUID

TECHNICAL FIELD

This invention relates to a copper-based alloy that possesses prescribed machinability securely, enjoys exalted mechanical properties and enjoys exalted castability as well and to a cast ingot and a liquid-contacting part that each use the alloy.

BACKGROUND ART

Among other alloys, particularly the bronze casting (CAC406) excels in castability, corrosion resistance, machinability and pressure resistance and, when molten, exhibits satisfactory flowability and, therefore, is suitable for cast parts with fairly complicated shapes. Thus, it has been being copiously used hitherto in the general plumbing hardware, such as valves, cocks and joints The CAC406 is used in copious amounts in water-contacting fittings for the plumbing hardware of this kind because it allows easy manufacture of wholesome castings and particularly excels in machinability owing to containing Pb in a weight ratio of about 5%.

When this bronze alloy is used for the material of water-contacting fittings, such as valves, the lead that is contained in the bronze castings in a state only sparingly reduced to a solid solution is eluted into the ambient water and consequently suffered to deteriorate the quality of the water. This phenomenon grows in prominence particularly when water stagnates in the water-contacting fittings.

Thus, the development of the so-called leadless copper alloy is underway at present. The efforts directed toward the development have resulted in proposing a number of improved alloys.

Typical examples thereof will be described hereinafter.

For example, a leadless copper alloy that acquires exalted machinability and allows prevention of dezincification by incorporating Bi in the place of lead into the copper alloy has been proposed (refer to pages 2-3 of JP-B HEI 5-63536).

A leadless bronze that enjoys exalted machinability in consequence of adding Ca to BC6 (CAC406), for example, thereby chiefly forming compounds with P (CaP, $Ca_3P_2$) and giving birth to an action of refining chips has been proposed (refer to pages 2-3 and FIG. 2 of Japanese Patent No. 2949061).

In this case, the precipitation of intermetallic compounds of CaP characterizes the production of the leadless bronze. The actual use of this product is difficult because Ca is an active metal and the addition of Ca into a copper alloy therefore results in inducing vigorous oxidation and markedly lowering the yield.

As another example, a leadless bronze that has exalted the mechanical strength thereof by adding Sb and consequently suppressing the occurrence of porosity during the course of casting due to the addition of Bi directed toward enhancing machinability has been proposed (refer to pages 3-6 of Japanese Patent No. 2889829). In this case, the addition of Ni is directed toward fortifying the matrix and preventing segregation.

As yet another example, a bronze cast material that has the crystal thereof refined as a substitution type intermetallic compound by the addition of Ti and has the crystal grain boundary strength thereof fortified as a penetration type intermetallic compound by the addition of B has been proposed (refer to pages 2-10 of Japanese Patent No. 2723817).

As still another example, a leadless free-cutting bronze alloy that has the machinability and the anti-seizing property thereof enhanced by the addition of Bi and has the anti-dezincification and the mechanical properties thereof acquired securely by the addition of Sn, Ni and P has been proposed (refer to pages 3-4 of JP-A 2000-336442).

As a further example, a bronze alloy that has the mechanical properties and the machinability thereof equalized with those of the CAC406 by adding Se and Bi to thereby particularly induce precipitation of a Se—Zn compound has been proposed (refer to columns 1-4 of U.S. Pat. No. 5,614,038).

Though the leadless bronze alloy materials proposed as described above invariably secure the specified magnitudes (tensile strength of 195 $N/mm^2$ or more and elongation of 15% or more) of a bronze alloy of JIS H5120 (CAC406), the aforementioned properties which the CAC 406 materials distributed in the market exhibit are in much greater magnitudes than those specified by JIS, such as tensile strength in the neighborhood of 240 $N/mm^2$ and elongation in the neighborhood of 33%. Thus, an alloy that is capable of securing mechanical properties and machinability equal to those secured by the materials circulating in the market has not been developed in the prior art mentioned above. Such is the existing state of affairs.

Then, the leadless bronze alloy mentioned above has added thereto Se, Bi, etc. as alternative components for Pb. Since these alternative components are expensive rare elements, the desirability of developing an alloy that secures the aforementioned properties in magnitudes equal to those of the CAC406 in the materials distributed in the market while the amounts of the rare elements to be added are decreased has been finding recognition.

Further, the leadless bronze alloy mentioned above has been proposed with a view to exalting mechanical properties and machinability. Pb, however, is a component that contributes to the wholesomeness of a casting. The question how the leadless bronze alloy secures the wholesomeness of a casting has not yet been elucidated.

This invention has been developed in consequence of a diligent study. It is aimed at providing a copper-based alloy that acquires mechanical properties at least equal to the bronze alloy (CAC406) generally used hitherto while securing machinability equal to the CAC406 in spite of a decrease in the content of rare elements (such as Bi and Se) in the alloy in consequence of exactly comprehending the true properties of the elements (such as Bi and Se) which are alternative components for Pb, realizes suppression of the occurrence of casting defects by elucidating the unresolved influence of the decrease of the alternative components (such as Bi and Se) for Pb on the wholesomeness of a casting, and further enables inexpensive production by decreasing the rare elements and is also aimed at providing a cast ingot and a liquid-contacting part each using the alloy.

DISCLOSURE OF THE INVENTION

To attain the above object, a first aspect of the present invention provides a copper-based alloy containing at least 2.8 to 5.0 wt % of Sn, 0.4 to 3.0 wt % of Bi and satisfying $0<Se\leqq0.35$ wt % to enable securing prescribed machinability and wholesomeness of a casting and exalt mechanical properties thereof.

The copper-based alloy contains the Se of 0.2 wt % or less.

Any one of the copper-based alloys contains the Sn in a range of 3.5 to 4.5 wt %, satisfies 0<P<0.5 wt % and further contains Ni of 3.0 wt % or less.

Another aspect of the present invention provides a copper-based alloy containing at least Sn, Bi and Se and containing at least one non-solid solution formed of an alternative component for Pb in an amount of 1.0 vol % or more to enable suppression of occurrence of a casting defect.

The copper-based alloy according to another aspect of the invention contains the at least one non-solid solution secured with Bi or with Bi and Se.

Any one of the copper-based alloys according to another aspect of the invention contains the at least one non-solid solution of 4.90 vol % or less.

Still another aspect of the present invention provides a cast ingot produced using any one of the alloys and a liquid-contacting part formed of the cast ingot.

According to the one aspect of the invention, by exactly comprehending the true properties of the rare elements (such as Bi and Se) which are alternative components for Pb, the alloy is enabled to secure machinability equal to the bronze alloy (CAC406) generally used hitherto and acquire mechanical properties at least equal to the CAC406 as well in spite of a decrease in the content of the rare elements (such as Bi and Se) in the alloy.

Further, the one aspect of the invention has succeeded in suppressing the occurrence of casting defects by elucidating the unresolved influence of the decrease of the alternative components (such as Bi and Se) for Pb on the wholesomeness of a casting.

Another aspect of the invention has made it possible to secure an amount of a non-solid solution effectively, suppress the occurrence of a casting defect and acquire a leadless copper-based alloy excelling in properties, such as pressure resistance.

Still another aspect of the invention has made it possible by decreasing the rare elements (such as Bi and Se) to produce a copper-based alloy containing rare elements (such as Bi and Se) at a low cost and provide an ingot and a liquid-contacting part each using the alloy.

BRIEF DESCRIPTION OF THE DRAWINGS

FIG. 21 is an explanatory diagram of an artist concept of a method of correction using an approximate straight-line a.

BEST MODE FOR CARRYING OUT THE INVENTION

Figure 1:
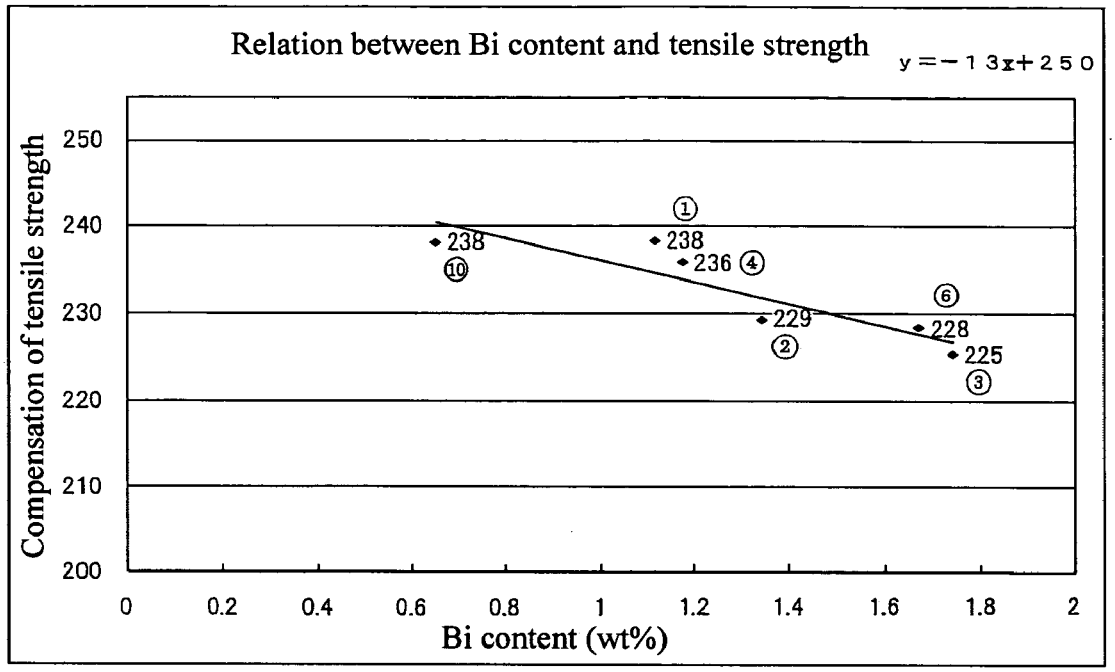
FIG. 1 is a graph showing the relation between the Bi content and the tensile strength found in a tensile test.

This invention will be described more specifically below with reference to the accompanying drawings.

This invention concerns a copper-based alloy which has been developed in consequence of exactly comprehending the true properties of the individual elements including the rare elements (such as Bi and Se) which are alternative components for Pb and establishing a range of composition of the copper-based alloy contemplated by this invention based on the true properties of the individual elements. The copper-based alloy is formed in a composition falling in the range most suitable for securing the prescribed machinability and the wholesomeness of a casting and acquiring exalted mechanical properties. One embodiment of the copper-based alloy and the ingot and the liquid-contacting part each using the alloy as contemplated by this invention will be described below.

The copper-based alloy of this invention adopts a composition which contains at least 2.8 to 5.0 wt % of Sn and 0.4 to 3.0 wt % of Bi, satisfies 0<Se≦0.35 wt % and contains the balance of Cu and unavoidable impurities.

The copper-based alloy of this invention in its preferred embodiment contains 2,8 to 5.0 wt % of Sn and 0.4 to 3.0 wt % of Bi, satisfies 0<Se≦0.35 wt %, also contains 5.0 to 10.0 wt % of Zn, 3.0 wt % or less of Ni, satisfies 0<P<0.5 wt %, and further contains less than 0.2 wt % of Pb and the balance of Cu.

The content of Se is preferred to be 0.2 wt % or less, and the content of Sn is preferred to fall in the range of 3.5 to 4.5 wt %.

The range of composition of the copper-based alloy contemplated by this invention and the reason for this range will be described below.

Bi: 0.4 to 3.0 wt %

This Bi content is effective in enhancing machinability. For the sake of getting into the porosity formed in a casting during the course of solidification of the casting, suppressing the occurrence of casting defects, such as a shrinkage cavity, and securing wholesomeness of the casting, a Bi content of 0.4 wt % or more in combination with a Se content of 0.2 wt % or more is effective.

Meanwhile, for the sake of securing mechanical properties that are considered necessary, the Bi content of 3.0 wt % or less is effective. Particularly the Bi content of 1.7 wt % or less is effective in sufficiently securing mechanical properties while suppressing the content of Bi.

Practically, the Bi content in the range of 0.8 to 1.7 wt % in addition to the Se content is preferable. When the most suitable Se content is taken into consideration, the optimum Bi content is about 1.3 wt %.

Se: $0<Se\leqq 0.35$ wt %

In the copper alloy, this element is present in the form of intermetallic compounds, such as Bi—Se, Se—Zn and Cu—Se. Similarly to Bi, this element Se forms a component that contributes to the secure acquisition of machinability and wholesomeness of a casting.

The Se content, therefore, is effective in securing mechanical properties and the wholesomeness of a casting that will be described specifically herein below while suppressing the Bi content.

It has been empirically demonstrated by the present inventors that the numerical values of mechanical properties, such as the tensile strength, of the copper-based alloy on the mass production level are variable, depending on the casting conditions, within the range of about 20% even when the numerical values of the components of the casting are approximately identical. For the purpose of satisfying the specification of JIS even when this variation causes the tensile strength to assume the lowest magnitude, it is necessary that the tensile strength of about 97% of the highest magnitude (about 250) be secured in the graph (FIG. 3) showing the relation between the Se content and the tensile strength which will be specifically described herein below. Thus, 0.35 wt % has been set as the upper limit of the magnitude. Se, when contained even in a trace, contributes to the acquisition of wholesomeness of a casting. For the sake of acquiring this action infallibly, the Se content of 0.1 wt % or more is effective. Thus, this value has been set as the preferably lower limit. Particularly about 0.2 wt % is the optimum value.

Sn: 2.8 to 5.0 wt %

This element Sn is contained for the purpose of forming a solid solution in the $\alpha$ phase, enhancing strength and hardness, and exalting abrasive resistance and corrosion resistance in consequence of the formation of a protective film of $SnO_2$. Sn is an element which has the machinability of the alloy linearly degraded in accordance as the content thereof is increased within the range of practical proportion.

It is, therefore, required to suppress the content thereof and further secure mechanical properties within the range of shunning degradation of corrosion resistance.

As a more preferred choice with a view to the characteristic property of elongation that is prone to the effect of the Sn content, the range of 3.5 to 4.5 wt % has been discovered as what allows the highest elongation (in the neighborhood of Sn=4.0 wt %) in the graph (FIG. 6) showing the relation between the Sn content and the elongation as specifically described herein below to be infallibly attained in spite of more or less variation in the casting conditions.

Further, the element Sn has been hitherto known to possess the property of fortifying the matrix of alloy and exalting the mechanical properties of the alloy proportionately to the increase in its content. As a result of a diligent study, it has been demonstrated that the tensile strength improves in proportion to the increase of the Sn content in the low range, reaches the peak when the Sn content is in the neighborhood of 4.4 wt %, and declines when the Sn content further increases as shown in the graph (FIG. 5) showing the relation between the Sn content and the tensile strength as specifically described herein below. Further, the data obtained by the study show that the relation between the Sn content and the elongation indicates nearly the same trend as the relation between the Sn content and the tensile strength.

Zn: 5.0 to 10.0 wt %

This element is effective in exalting hardness and mechanical properties, elongation in particular, without exerting any influence on machinability.

Further, this element Zn is effective in suppressing the formation of an Sn oxide due to the absorption of gas into the molten alloy and ensuring wholesomeness of the molten alloy. For the sake of the manifestation of this action, the effective Zn content is 5.0 wt % or more. More practically, the Zn content is preferred to be 7.0 wt % or more from the viewpoint of compensating the portions of Bi and Se subject to suppression.

Since the element Zn has a high vapor pressure, the Zn content is preferred to be 10.0 wt % or less in consideration of the safety of the working atmosphere and the castability of the alloy. Particularly the optimum Zn content is about 8.0 wt % when economy is further taken into consideration.

Ni: 3.0 wt % or Less

Even when absolutely no Ni is contained, necessary mechanical properties, such as tensile strength, are acquired by satisfying the relational expression A that will be described more specifically herein below. The Ni that is added with a view to more effectively exalting the mechanical properties of the alloy merges into the a solid solution to a certain fixed degree, fortifies the matrix of the alloy and exalts the mechanical properties of the alloy. If the Ni content exceeds this fixed degree, the overage will result in forming intermetallic compounds of Ni with Cu and Sn and degrading the mechanical properties while exalting machinability.

For the purpose of exalting the mechanical strength, the Ni content of 0.2 wt % or more is effective. The peak of the mechanical strength nevertheless exists at the Ni content of about 0.6 wt %. Thus, the range of 0.2 to 0.75 wt % has been specified for the proper Ni content.

P: $0<P<0.5$ wt %

With the object of promoting dezincification of the molten copper alloy and ensuring manufacture of wholesome castings and continuously cast ingots, P is added in an amount of less than 0.5 wt %. If this element is contained excessively, the overage will result in lowering a solidus line, tending to induce segregation and giving birth to embrittlement in consequence of the formation of P compounds.

The P content, therefore, is preferred to be in the range of 200 to 300 ppm in the case of die-casting and in the range of 0.1 to 0.2 wt % in the case of continuous casting.

Pb: Less Than 0.2 wt %

As the range of unavoidable impurity not positively containing Pb, the Pb content of less than 0.2 wt % has been adopted.

Further, the copper-based alloy contemplated by this invention is enabled to acquire exalted tensile strength by containing at least Sn, Bi and Se in respective ranges satisfying the relational expression:

$$-3.6Sn^2+32Sn-13Bi-30(Se-0.2)-26Ni^2+32Ni+(185\pm 20)>195.$$

Then, by substituting the numerical values of the components for the relevant letter symbols in the relational expression mentioned above, it is made possible to comprehend the characteristic properties of the materials on the mass production level without carrying out an experiment and consequently obtain a copper-based alloy satisfying the specification of JIS, for example. The relational expression mentioned above will be described specifically herein below.

The copper-based alloy contemplated by this invention is enabled to acquire nearly the same machinability as the CAC406 by containing at least Sn, Bi and Se in respectively ranges satisfying the relational expression:

$$-1.8Sn+10Bi+6Se+(79\pm2)>80.$$

Then, by substituting the numerical values of the components for the relevant letter symbols in the relational expression mentioned above, it is made possible to comprehend the characteristic properties of the materials on the mass production level without carrying out an experiment and consequently obtain a copper-based alloy satisfying the specification of JIS, for example. The relational expression mentioned above will be described specifically herein below.

The copper-based alloy of this invention contains at least Sn, Bi and Se. By containing a non-solid solution formed of an alternative component for Pb in an amount of 1.0 vol % or more, it is enabled to suppress the occurrence of a casting defect.

The term "non-solid solution" refers to an element or a compound that shuns forming a solid solution in the matrix of an alloy within the practical range and exists along the crystal grain boundary or in the grain. Since this non-solid solution possesses an action of permeating the microporosity due to the solidified form peculiar to a bronze casting and filling up the microporosity, it is enabled to suppress the occurrence of casting defects, such as shrinkage cavity and produce a wholesome casting which secures pressure resistance for a cast article.

The copper-based alloy contemplated by this invention secures the non-solid solution with at least Bi or with at least Bi and Se. The content of this non-solid solution is preferred to be 4.90 vol % or less.

The copper-based alloy of this invention mentioned above is provided in the form of an intermediate product, such as a cast ingot or continuous casting article, or directly applied to a liquid-contacting part formed by casting and processing.

As concrete examples of the liquid-contacting parts which are widely in use, valve parts for potable water, such as valves, stems, valve seats and discs; plumbing hardware, such as faucets and joints; devices for feed pipes and drain pipes; devices, such as strainers, pumps and motors which are fated to contact liquid; faucet fitting destined to contact liquid; devices handling hot water, such as hot-water supply devices; parts and component members for service water lines; and further intermediate parts, such as coils and hollow rods; besides the finished products and the assembled articles enumerated above may be cited.

A method for comprehending the true characteristic properties of the individual elements of the aforementioned copper-based alloy of this invention has been discovered in consequence of a diligent study pursued in search of a range of the composition of the copper-based alloy. The range of the composition of the copper-based alloy of this invention, consequently, has been determined by accurately analyzing the data obtained by a test for tensile strength and a test for machinability.

To explain the method mentioned above, the test for tensile strength has been unable to comprehend the true characteristic properties of Sn because an attempt to evaluate the effect of Sn on an alloy requires this evaluation to be carried out on the basis of the actually measured values which have been influenced by other elements owing to the fact that the individual samples used for the test contain the component elements in varying amounts. Thus, the evaluation has been performed as follows with a view to eliminating the effects of the variations of such other elements.

(Step 1)

Figure 21:
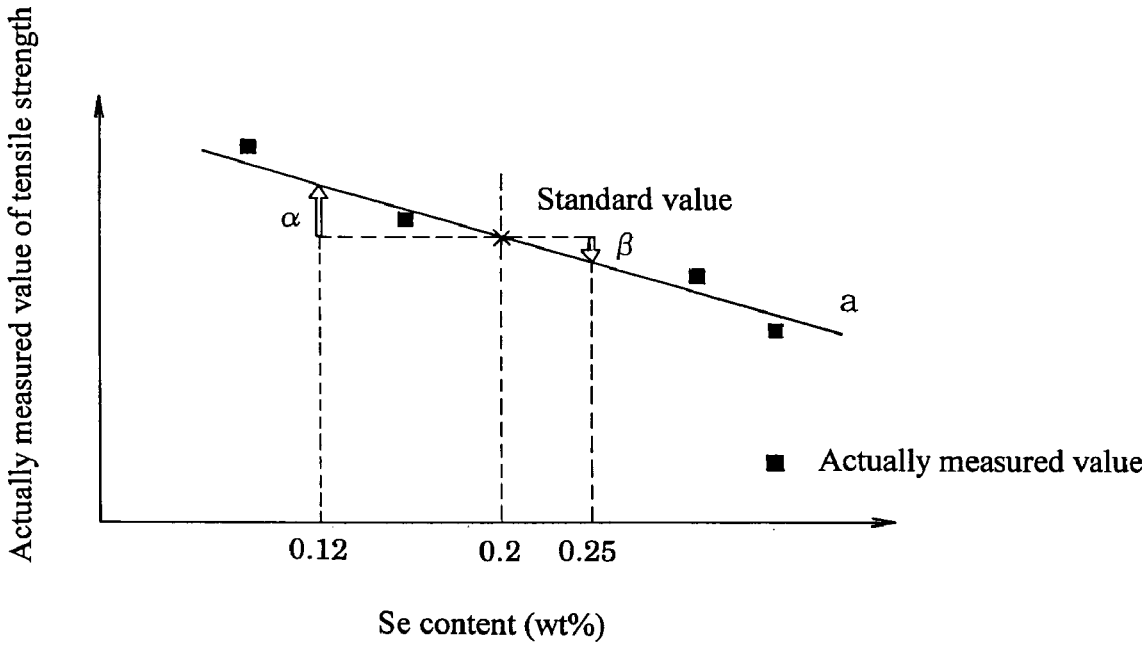

First, to find the characteristic properties of Se, several samples containing components other than Se in comparatively near amounts (for example, the sample Nos. 14 to 18, described in Tables 1, 3 and 4 in the test example which will be specifically described herein below) are extracted and the relation between the Se content and the tensile strength determined on the basis of the actually measured values is plotted on a characteristic graph to describe an approximate straight-line a. A conceptual diagram depicting this step is shown in FIG. 21.

(Step 2)

Next, to find the characteristic property of Bi, several samples containing components other than Bi in comparatively near amounts (for example, the sample Nos. 1 to 4, 6 and 16 described in Tables 1, 3 and 4 in the test example which will be specifically described herein below) are extracted and the relation between the Bi content and the tensile strength determined on the basis of the actually measured values is plotted on a characteristic graph. In this case, the influence of the variation of the Se content is corrected on the base of the characteristic graph of Se mentioned above.

In the test example which will be specifically described herein below, for example, the comparison between the sample No. 3 and the sample No. 4 with respect to the influence of the Bi content on the tensile strength requires a correction of subtracting the increment or decrement of the tensile strength based on the difference of the Se contents of 0.12 and 0.25.

Figure 22:
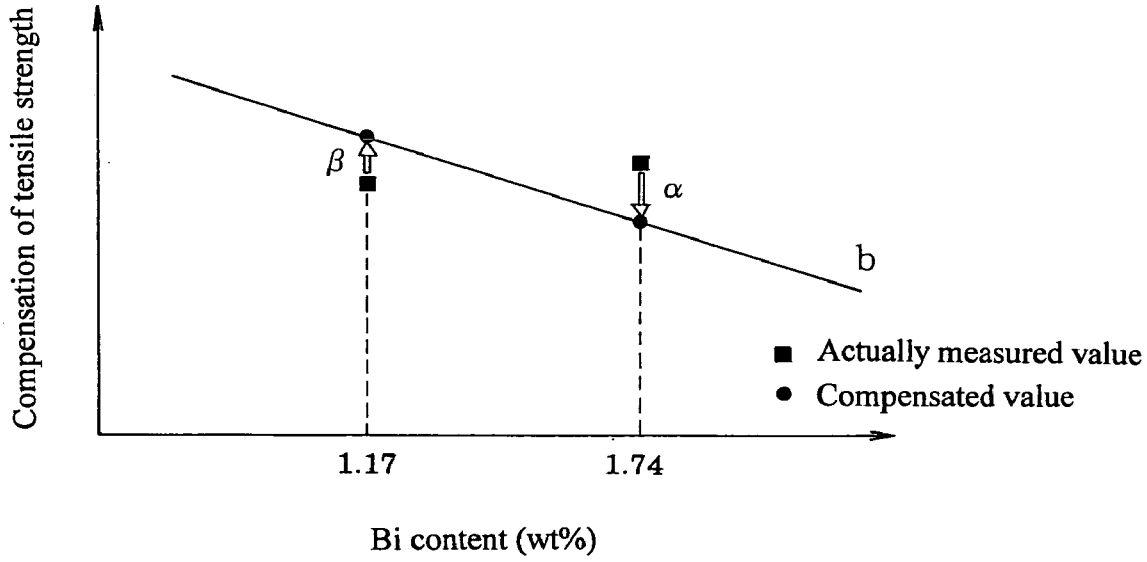
FIG. 22 is an explanatory diagram of an artist concept of a method for correction using an approximate straight-line b.

To be specific, the standard value of the Se content (0.2 in this case) is set and the increment or decrement $\alpha$, $\beta$ of tensile strength, i.e. Se=0.12 and 0.25, from the standard value is calculated by using the approximate straight-line a. By effecting the compensation of decreasing or increasing the $\alpha$, $\beta$ to the values of the tensile strength at Bi=1.74 and 1.17, it is made possible to express the characteristic properties of Bi when the Se content is fixed at 0.2. A conceptual diagram depicting the case of drawing the approximate straight-line b based on the values of compensation thus found is shown in FIG. 22.

Incidentally, by using the average value of the Se contents in the samples subjected to the evaluation as the standard value mentioned above, it is made possible to easily comprehend the characteristic properties of an alloy because the compensated value is allowed to fall in the range of numerical value that the actual tensile strength is capable of acquiring. Optionally, the compensation using 0, as the standard value, may be performed.

(Step 3)

Subsequently, to find the characteristic properties of Sn, several samples containing components other than Sn in comparatively near amounts (for example, the sample Nos. 5, 11 to 13 and 24 to 26 described in Tables 1, 3 and 4 in the test example which will be specifically described herein below) are extracted and the relation between the Sn content and the tensile strength determined on the basis of the actually measured values is plotted on a characteristic graph (not shown). In this case, the influences of the variations of the Se and Bi contents are compensated on the basis of the approximate straight-lines a and b in the aforementioned graphs of Se and Bi.

(Step 4)

The process is returned to Step 1 to compensate the influences of the variations in the Bi and Sn content on the basis of the aforementioned graphs of Sn and Bi.

(Step 5)

Subsequently, Step 1, Step 2 and Step 3 are performed up to several repetitions to obtain a converged value.

Through the process described above, the characteristic value liberated from the influences of the other elements is obtained. As shown in the test examples which will be described specifically herein below, for example, these characteristic values will be shown as values of compensation in Table 4 and Table 5 and will be depicted in the graphs of FIG. 1 to FIG. 14.

To be specific, the influences which the contents of specific elements, such as Sn, exert on the characteristic properties of the alloy to be produced are evaluated by finding the difference between the standard content of a given element and the actual content thereof in a given sample, calculating the increment or the decrement of the values of characteristic properties of alloy, such as tensile strength, based on the difference in content, and compensating the actual characteristic value of alloy with respect to a specific element by using the values of increment or decrement.

Now, examples of this invention including testing examples of copper-based alloys will be described below.

The components shown in Table 1 and Table 2 are the results actually obtained by analyzing test pieces for testing tensile strength and test pieces for testing machinability. Particularly, the Pb components are found to be on the impurity level (0.02 wt % or less) and the Sb components are also found to be on the impurity level (less than 0.2 wt %).

(Test for Tensile Strength)

The test piece for testing tensile strength was a test piece ($CO_2$ mold) conforming to JIS No. 4. The test was performed with an Amsler testing machine at a casting temperature of 1130° C.

The results of the test for tensile strength are shown in Table 3.

(Test for Machinability)

The test piece for testing machinability was prepared by cutting a given cylindrical workpiece material with a lathe. The machinability was determined by rating the cutting resistance exerted on the cutting tool with the machinability index, using the cutting resistance offered by a bronze casting CAC406 as 100. The testing conditions were 1180° C. in casting temperature ($CO_2$ mold), 31 mm of diameter× 260 mm of length in shape of the workpiece material, 3.2 in surface roughness $R_A$, 3.0 mm of cutting depth in wall thickness, 1800 rpm in rotational frequency of the lathe, 0.2 mm/rev in feeding amount, and no use of oil.

The results of the test for machinability are shown in Table 3 and Table 5.

TABLE 1

Contents of components 1

| | Contents of chemical components (unit: wt %, proving that P stands for ppm) | | | | | | | |
|---|---|---|---|---|---|---|---|---|
| No. | Cu | Zn | Sn | Bi | Se | Ni | Pb | P |
| 1 | 87.7 | 7.9 | 3.17 | 1.11 | 0.11 | 0 | 0 | 277 |
| 2 | 87.7 | 7.56 | 3.18 | 1.34 | 0.12 | 0 | 0.01 | 281 |
| 3 | 87.5 | 7.55 | 3.05 | 1.74 | 0.12 | 0 | 0 | 256 |
| 4 | 87.5 | 7.8 | 3.24 | 1.17 | 0.25 | 0 | 0 | 259 |

TABLE 1-continued

Contents of components 1

| | Contents of chemical components (unit: wt %, proving that P stands for ppm) | | | | | | | |
|---|---|---|---|---|---|---|---|---|
| No. | Cu | Zn | Sn | Bi | Se | Ni | Pb | P |
| 5 | 87.4 | 7.8 | 3.21 | 1.36 | 0.24 | 0 | 0.01 | 243 |
| 6 | 87.4 | 7.51 | 3.12 | 1.67 | 0.23 | 0 | 0.01 | 290 |
| 7 | 87.2 | 7.74 | 3.43 | 1.2 | 0.4 | 0 | 0.02 | 260 |
| 8 | 87 | 8.06 | 3.26 | 1.41 | 0.27 | 0 | 0 | 261 |
| 9 | 86.5 | 7.8 | 3.05 | 1.77 | 0.4 | 0 | 0 | 276 |
| 10 | 88.3 | 7.72 | 3.17 | 0.65 | 0.12 | 0 | 0 | 271 |
| 11 | 86.4 | 7.92 | 4.1 | 1.29 | 0.23 | 0 | 0.01 | 256 |
| 12 | 89.6 | 5.54 | 3.54 | 1.53 | 0.24 | 0 | 0.01 | 281 |
| 13 | 85.4 | 7.7 | 5.31 | 1.34 | 0.23 | 0 | 0.02 | 281 |
| 14 | 86.9 | 7.79 | 3.77 | 1.53 | 0 | 0 | 0.01 | 301 |
| 15 | 86.3 | 7.75 | 4.04 | 1.77 | 0.18 | 0 | 0.01 | 312 |
| 16 | 86.2 | 7.54 | 4.16 | 1.68 | 0.35 | 0 | 0.01 | 286 |
| 17 | 86.1 | 7.82 | 4.02 | 1.62 | 0.5 | 0 | 0.01 | 272 |
| 18 | 85.9 | 7.93 | 3.91 | 1.46 | 0.75 | 0 | 0.01 | 279 |
| 19 | 87.35 | 7.91 | 3.13 | 1.33 | 0.25 | 0.24 | 0 | 239 |
| 20 | 87.1 | 7.5 | 3.21 | 1.39 | 0.23 | 0.59 | 0 | 230 |
| 21 | 86.1 | 7.76 | 3.42 | 1.55 | 0.29 | 0.79 | 0.01 | 257 |
| 22 | 86.5 | 7.72 | 3.12 | 1.33 | 0.25 | 0.9 | 0.01 | 290 |
| 23 | 86.1 | 7.91 | 3.13 | 1.34 | 0.25 | 1.14 | 0.01 | 267 |
| 24 | 85.8 | 7.8 | 4.39 | 1.46 | 0.24 | 0.25 | 0 | 260 |
| 25 | 85.1 | 7.66 | 5.36 | 1.35 | 0.21 | 0.23 | 0 | 270 |
| 26 | 88.3 | 7.87 | 2.22 | 1.04 | 0.52 | 0 | 0 | 275 |
| 27 | 85.5 | 9.66 | 3.15 | 1.38 | 0.23 | 0 | 0 | 271 |
| 28 | 85.4 | 9.4 | 3.28 | 1.38 | 0.26 | 0.25 | 0 | 290 |
| 29 | 88.9 | 5.81 | 3.3 | 1.47 | 0.25 | 0.25 | 0 | 257 |

TABLE 2

Contents of components 2

| | Contents of chemical components (unit: wt %, proving that P stands for ppm) | | | | | | | |
|---|---|---|---|---|---|---|---|---|
| No. | Cu | Zn | Sn | Bi | Se | Ni | Pb | P |
| 30 | 87.7 | 8.04 | 3.25 | 0.61 | 0.37 | 0 | 0 | 267 |
| 31 | 88.9 | 7.92 | 2.22 | 0.56 | 0.34 | 0 | 0.01 | 263 |
| 32 | 86.8 | 7.87 | 4.25 | 0.61 | 0.4 | 0 | 0.01 | 253 |
| 33 | 87.5 | 7.92 | 3.15 | 1.04 | 0.5 | 0 | 0.02 | 273 |
| 34 | 88.4 | 7.69 | 2.32 | 1.01 | 0.53 | 0 | 0.02 | 268 |
| 35 | 86.5 | 7.79 | 4.24 | 0.99 | 0.53 | 0 | 0.01 | 251 |
| 36 | 87.9 | 8.11 | 3.31 | 0.4 | 0.21 | 0 | 0.02 | 289 |
| 37 | 87.7 | 8 | 3.17 | 0.78 | 0.44 | 0 | 0.01 | 284 |
| 38 | 87.1 | 7.93 | 3.16 | 0.58 | 0.36 | 0.75 | 0.02 | 281 |
| 39 | 88.3 | 7.33 | 3.19 | 0.73 | 0.37 | 0 | 0.01 | 287 |
| 40 | 87.2 | 7.37 | 3.07 | 0.69 | 0.37 | 0.95 | 0.02 | 270 |
| 41 | 86.3 | 8.39 | 4.05 | 1.25 | 0 | 0 | 0 | 251 |
| 42 | 86.2 | 8.30 | 4.08 | 1.22 | 0.16 | 0 | 0 | 249 |

TABLE 3

Results of test for characteristic properties and calculated values

| | Results of test | | | | | |
|---|---|---|---|---|---|---|
| | Tensile strength, $N/mm^2$ | | Elongation | | Machinability | |
| No. | Found | Calculated | Found | Calculated | Found | Calculated |
| 1 | 232 | 235 | 28 | 29 | 85 | 85 |
| 2 | 223 | 232 | 26 | 26 | | |
| 3 | 220 | 226 | 22 | 22 | | |
| 4 | 231 | 233 | 29 | 28 | | |
| 5 | 230 | 231 | 28 | 26 | 90 | 89 |

TABLE 3-continued

Results of test for characteristic properties and calculated values

| | Results of test | | | | | |
|---|---|---|---|---|---|---|
| | Tensile strength, $N/mm^2$ | | Elongation | | Machinability | |
| No. | Found | Calculated | Found | Calculated | Found | Calculated |
| 6 | 224 | 226 | 25 | 23 | 92 | 92 |
| 7 | 223 | 230 | 26 | 27 | | |
| 8 | 217 | 230 | 25 | 26 | | |
| 9 | 205 | 220 | 21 | 21 | | |
| 10 | 232 | 241 | 31 | 32 | | |
| 11 | 237 | 236 | 28 | 29 | 86 | 86 |
| 12 | 223 | 231 | 23 | 23 | 90 | 90 |
| 13 | 230 | 232 | 21 | 23 | | |
| 14 | 243 | 233 | 28 | 27 | | |
| 15 | 240 | 231 | 27 | 25 | | |
| 16 | 235 | 228 | 26 | 25 | 91 | 92 |
| 17 | 232 | 224 | 26 | 25 | | |
| 18 | 228 | 219 | 25 | 24 | | |
| 19 | 236 | 236 | 29 | 29 | 88 | 86 |
| 20 | 240 | 241 | 31 | 30 | | |
| 21 | 236 | 238 | 32 | 30 | | |
| 22 | 239 | 238 | 33 | 30 | | |
| 23 | 234 | 233 | 28 | 29 | | |
| 24 | 236 | 240 | 27 | 30 | | |
| 25 | 230 | 221 | 23 | 25 | | |
| 26 | 231 | 215 | 19 | 19 | | |
| 27 | 227 | 230 | 32 | 29 | 88 | 89 |
| 28 | 234 | 237 | 30 | 31 | | |
| 29 | 228 | 236 | 24 | 25 | | |

TABLE 4

Values of compensation of characteristic property

| | Compensation of tensile strength | | | | Compensation of elongation | | | | | Compensation of machinability | | |
|---|---|---|---|---|---|---|---|---|---|---|---|---|
| No. | Bi | Ni | Sn | Se | Bi | Ni | Sn | Se | Zn | Bi | Se | Sn |
| 1 | 238 | | | | 26 | | | | | 86 | 83 | 84 |
| 2 | 229 | | | | 25 | | | | | | | |
| 3 | 225 | | | | 20 | | | | | | | |
| 4 | 236 | | | | 28 | | | | 22 | | | |
| 5 | | 234 | 229 | | 27 | | 27 | | 22 | 91 | 85 | 86 |
| 6 | 228 | | | | 24 | | | | | 93 | 84 | 85 |
| 7 | | | | | 27 | | | | | | | |
| 8 | | | | | 24 | | | | | | | |
| 9 | | | | | 20 | | | | | | | |
| 10 | 238 | | | | 29 | | | | | | | |
| 11 | | | 235 | | | | 27 | | | 88 | 84 | 83 |
| 12 | | | 224 | | | | | | 20 | 91 | 84 | 84 |
| 13 | | | 229 | | | | 20 | | | | | |
| 14 | | | | 249 | | | | 28 | | | | |
| 15 | | | | 250 | | | | 30 | | | | |
| 16 | | | | 244 | | | | 28 | | 93 | 85 | 83 |
| 17 | | | | 240 | | | | 26 | | | | |
| 18 | | | | 234 | | | | 26 | | | | |
| 19 | | 239 | | | | | | | | 89 | 84 | 85 |
| 20 | | 245 | | | | 30 | | | | | | |
| 21 | | 243 | | | | 31 | | | | | | |
| 22 | | 242 | | | | 31 | | | | | | |
| 23 | | 237 | | | | 29 | | | | | | |
| 24 | | | 236 | | | 29 | 29 | | | | | |
| 25 | | | 229 | | | | 25 | | | | | |
| 26 | | | 216 | | | | 18 | | | | | |
| 27 | | | | | | | | | 26 | 89 | 84 | 84 |
| 28 | | | | | | | | | 27 | | | |
| 29 | | | | | | | | | 22 | | | |

TABLE 5

Results of test for individual characteristic properties in test for conformation of machinability, calculated values and values of compensation

| | Results of test Machinability | | Values of compensation of machinability | | |
|---|---|---|---|---|---|
| N0. | Found | Calculated | Bi | Se | Sn |
| 30 | 82 | 82 | 82 | 85 | 85 |
| 31 | 83 | 83 | 81 | 85 | 86 |
| 32 | 80 | 80 | 82 | 85 | 83 |
| 33 | 87 | 87 | 86 | 85 | 85 |
| 34 | 89 | 88 | 86 | 86 | 87 |
| 35 | 85 | 85 | 86 | 86 | 83 |
| 36 | 80 | 78 | 81 | 85 | 86 |
| 37 | 85 | 84 | 84 | 86 | 85 |
| 38 | 80 | 79 | 80 | 84 | 84 |
| 39 | 82 | 83 | 82 | 84 | 84 |
| 40 | 83 | 84 | 83 | 85 | 85 |
| 41 | 84 | 84 | 88 | 82 | 83 |
| 42 | 85 | 85 | 88 | 84 | 83 |

The results of the tensile test (casting temperature 1130° C., $CO_2$ mold) performed for the purpose of analyzing the influences of the individual elements on mechanical properties according to the method described above are shown in the graphs of FIGS. 1 through 10 and the results of the machinability test (casting temperature 1180° C., $CO_2$ mold) performed for the purpose of analyzing the influences of the individual elements on machinability are shown in the graphs of FIGS. 11 through 14.

Figure 10:
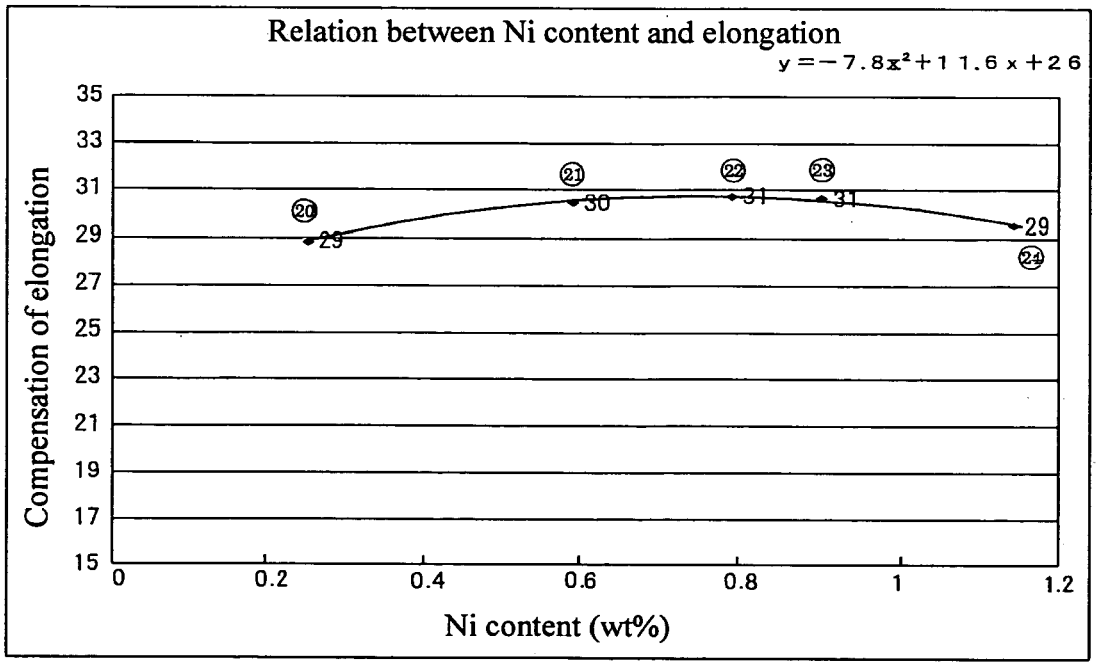
FIG. 10 is a graph showing the relation between the Ni content and the elongation found in a tensile test.
Figure 11:
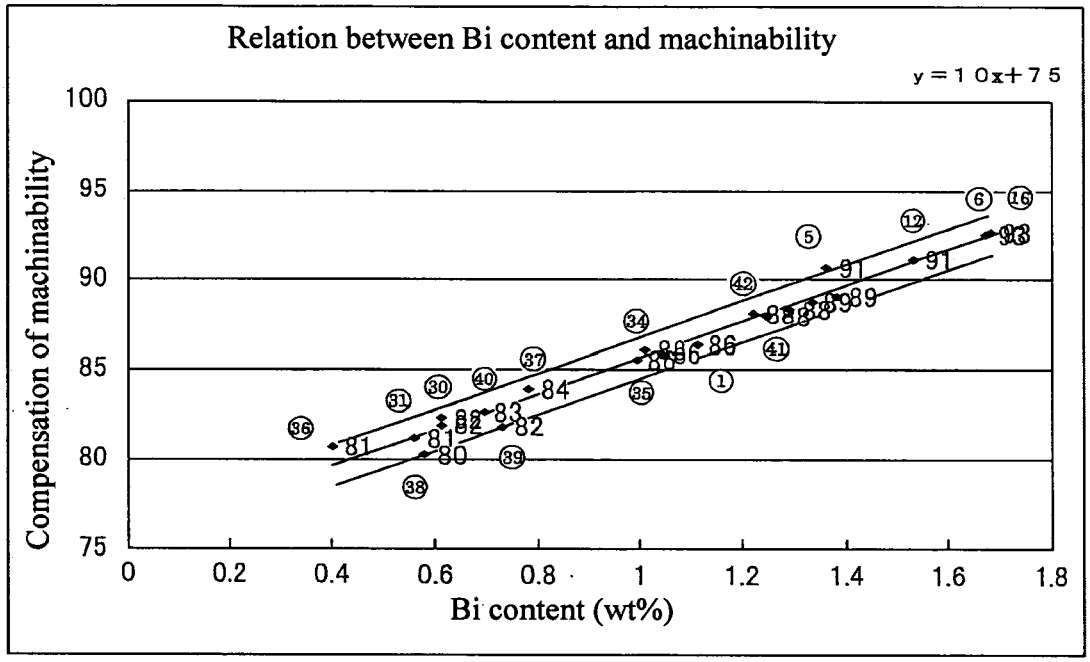
FIG. 11 is a graph showing the relation between the Bi content and the machinability found in a tensile test.
Figure 12:
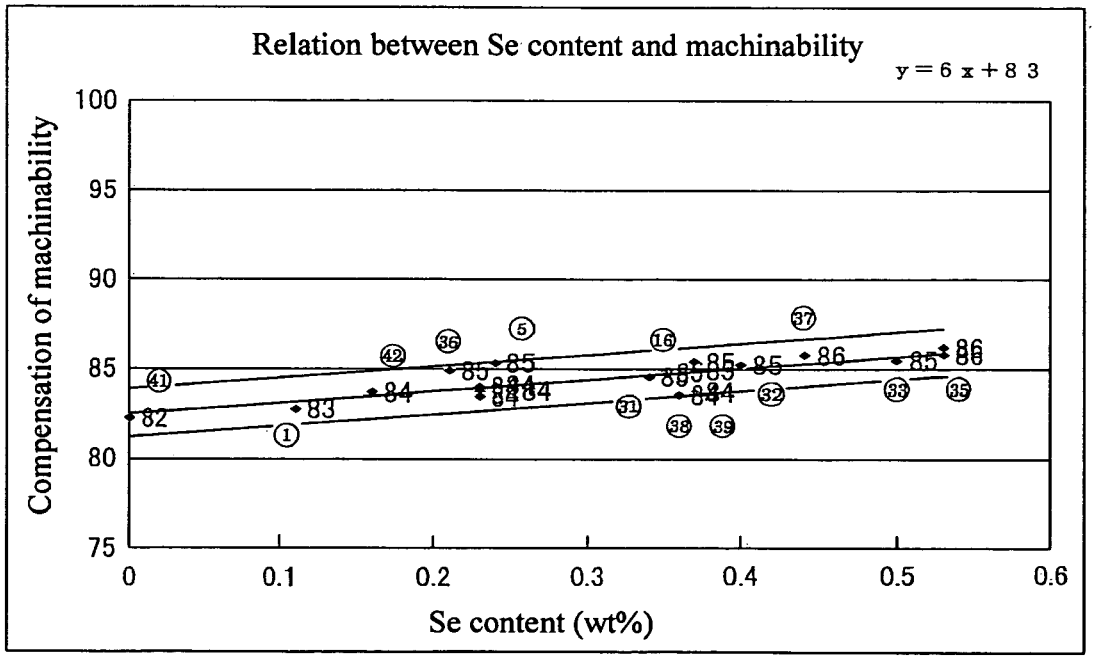
FIG. 12 is a graph showing the relation between the Se content and the machinability found in a tensile test.

In FIGS. 11 and 12, of the lines shown in each of the graphs, the line at the center is a regression line and the two lines on the opposite sides of the central line are predicted sections of estimated values. The predicted section of an estimated value indicates that when a certain value on the regression line is taken as an average and the normal distribution is assumed to occur above and below this average, theoretically 95% of data is present in this section. The width of the predicted section decreases in proportion as the number of pieces of data increases because the width of the predicted section narrows in accordance as the reliability of the regression line is heightened and it also depends on the number of pieces of data as well. This concept of the predicted section of the estimated value applies to FIGS. 1 to 10, 13 and 14.

(Tensile Test)

Relation Among Bi Content, Tensile Strength and Elongation:

FIG. 1 is a graph showing the relation between the Bi content and the tensile strength found in the tensile test. It is clear from this graph that the tensile strength declines at a ratio of −13Bi (formula a) in proportion as the Bi content is increased.

Figure 2:
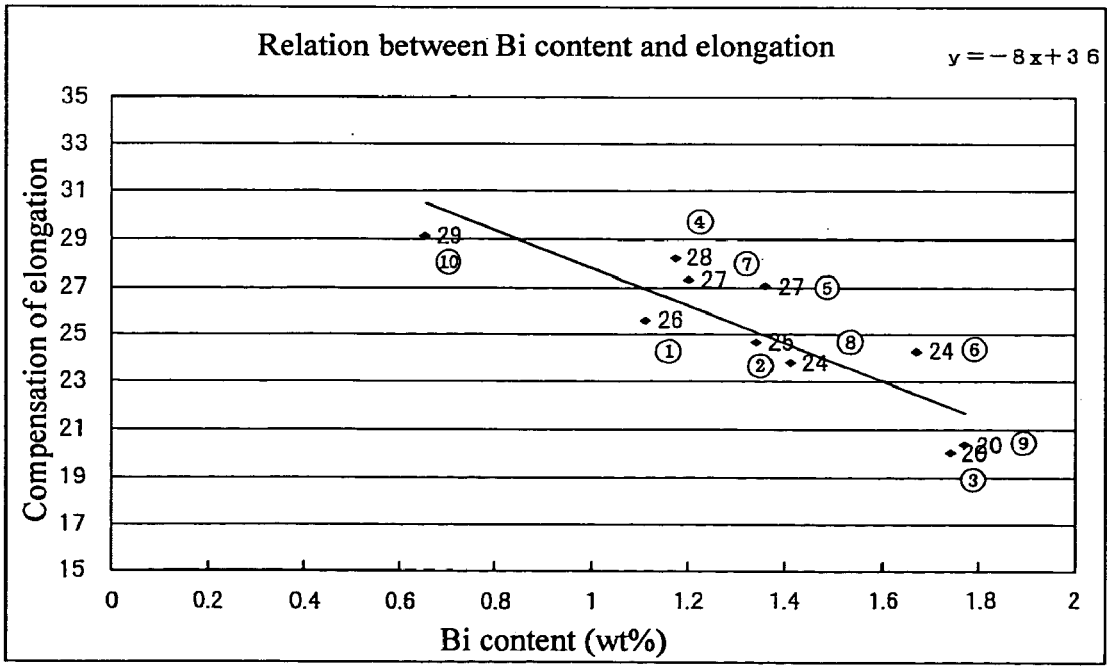
FIG. 2 is a graph showing the relation between the Bi content and the elongation found in a tensile test.

FIG. 2 is a graph showing the relation between the Bi content and the elongation found in the tensile test. It is clear from this graph that the elongation declines similarly to the tensile strength at a ratio of −8Bi (formula b) in proportion as the Bi content is increased.

(Machinability Test)

Relation Between Bi Content and Machinability:

FIG. 11 is a graph showing the relation between the Bi content and the machinability found in the machinability test. It is clear from this graph that the machinability is affected at a ratio of 10Bi (formula j) in proportion as the Bi content is decreased.

(Tensile Test)

Figure 3:
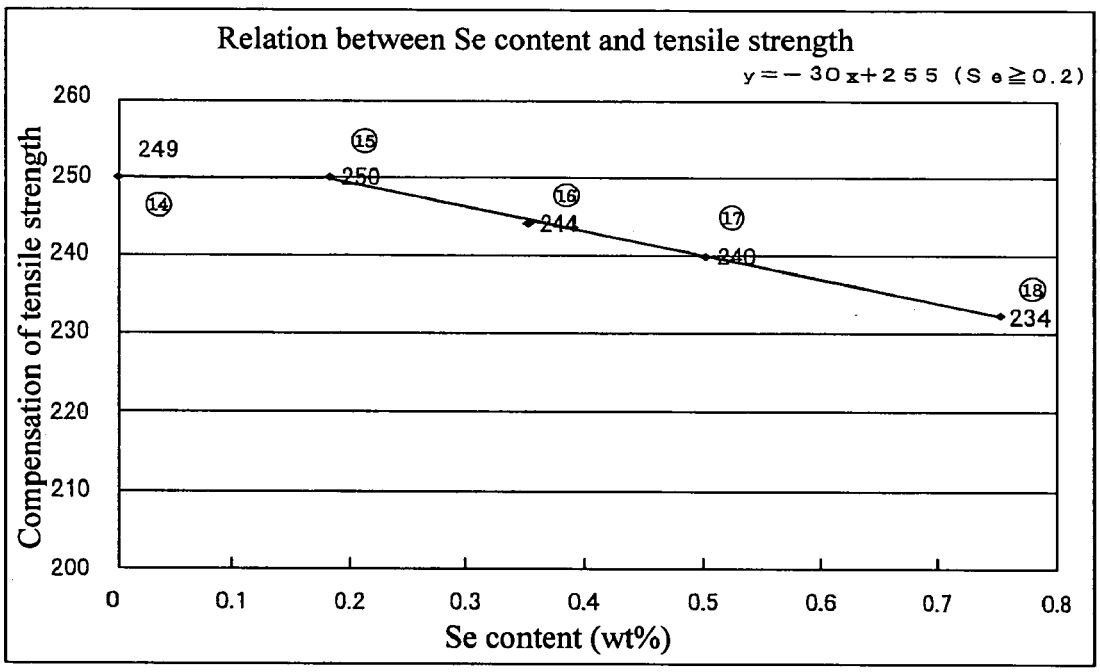
FIG. 3 is a graph showing the relation between the Se content and the tensile strength found in a tensile test.

Relation Among Se Sontent, Tensile Strength and Elongation:

FIG. 3 is a graph showing the relation between the Se content and the tensile strength found in the tensile test. It is clear from this graph that the tensile strength is increased in proportion as the Se content is decreased but that the tensile strength reaches the maximum level and remains there between the Se contents of 0 to 0.2 wt %.

When the Se content exceeds 0.2 wt %, the tensile strength is decreased at a ratio of −30 Se (formula c) in proportion as the Se content is increased.

Figure 4:
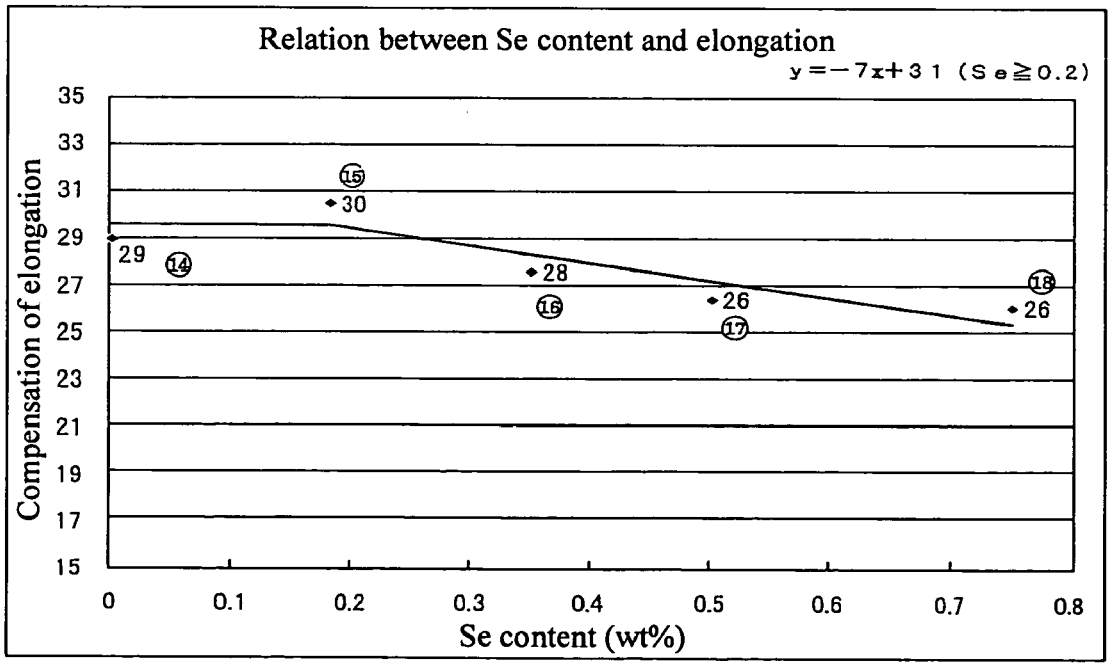
FIG. 4 is a graph showing the relation between the Se content and the elongation found in a tensile test.

FIG. 4 is a graph showing the relation between the Se content and the elongation found in the tensile test. It is clear from this graph that the elongation is increased in proportion as the Se content is decreased but that this increase of the elongation ceases when the Se content reaches the boundary of about 0.2 wt %.

When the Se content exceeds 0.2 wt %, the elongation is decreased similarly to the tensile strength at a ratio of −7Se (formula d) in proportion and the Se content is increased.

Incidentally, the machinability of the alloy in this range is about 10% less the machinability of the CAC 406 as shown by the data of the sample Nos. 5, 12 and 27 described in Tables 1, 3 and 4. The alloy, therefore, can be worked under nearly the same cutting conditions as the CAC 406.

(Machinability Test)

Relation Between Se Content and Machinability:

FIG. 12 is a graph showing the relation between the Se content and the machinability found in the machinability test. It is clear from this graph that the machinability is affected at a ratio of 6Se (formula k) in proportion as the Se content is decreased.

(Tensile Test)

Figure 5:
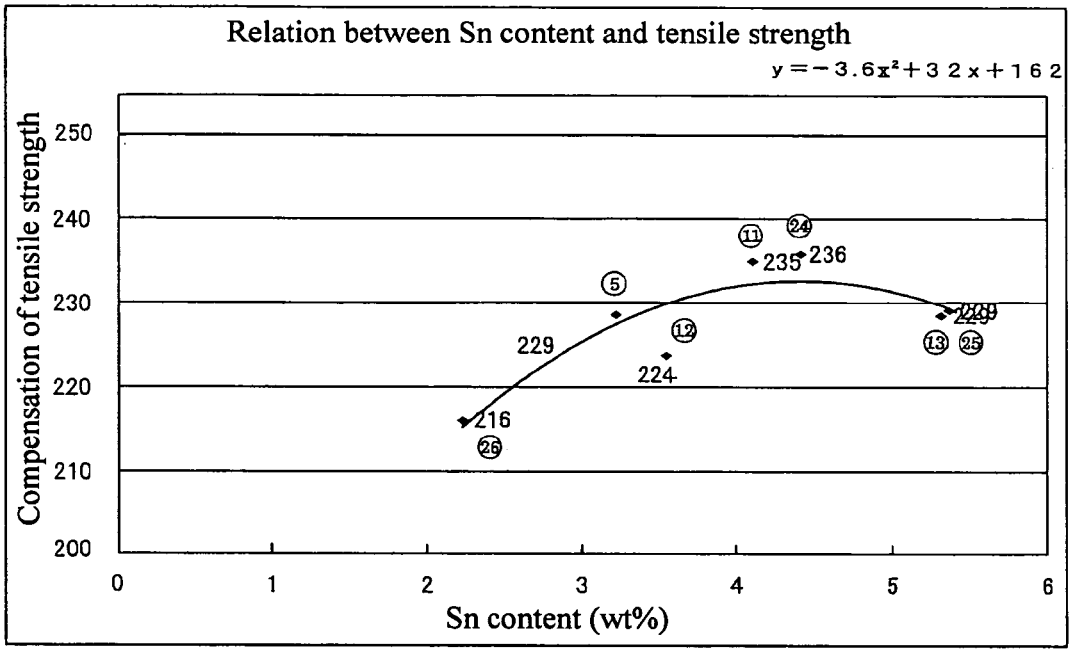
FIG. 5 is a graph showing the relation between the Sn content and the tensile strength found in a tensile test.

Relation Among Sn Content, Tensile Strength and Elongation:

FIG. 5 is a graph showing the relation between the Sn content and the tensile strength found in the tensile test. It is clear from this graph that the tensile strength is increased in proportion as the Sn content is increased while the Sn content is in a low range, but that the tensile strength reaches the peak in the neighborhood of 4.4 wt % of the Sn content and begins to decrease beyond this neighborhood.

This phenomenon may be possibly explained logically by supposing that in the neighborhood of the Sn content of 4 wt %, the precipitation of the a $\alpha+\delta$ phase is induced under the influence of the solute densified in the finally coagulated part. The influence exerted by the Sn content on the tensile strength may be expressed as $-3.6Sn^2+32Sn$ (formula e).

Figure 6:
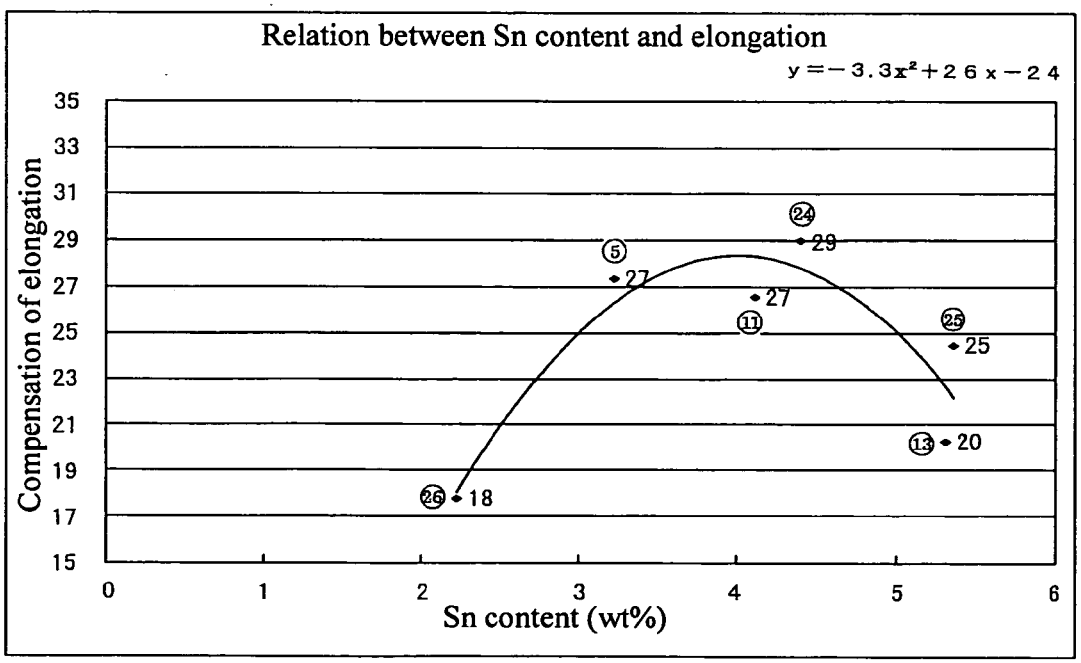
FIG. 6 is a graph showing the relation between the Sn content and the elongation found in a tensile test.

FIG. 6 is a graph showing the relation between the Sn content and the elongation found in the tensile test. This relation indicates nearly the same trend as the characteristic property of tensile strength shown in the graph of FIG. 5. The influence of the Sn content on the elongation may be expressed as $-3.3Sn^2+26Sn$ (formula f).

(Machinability Test)

Figure 13:
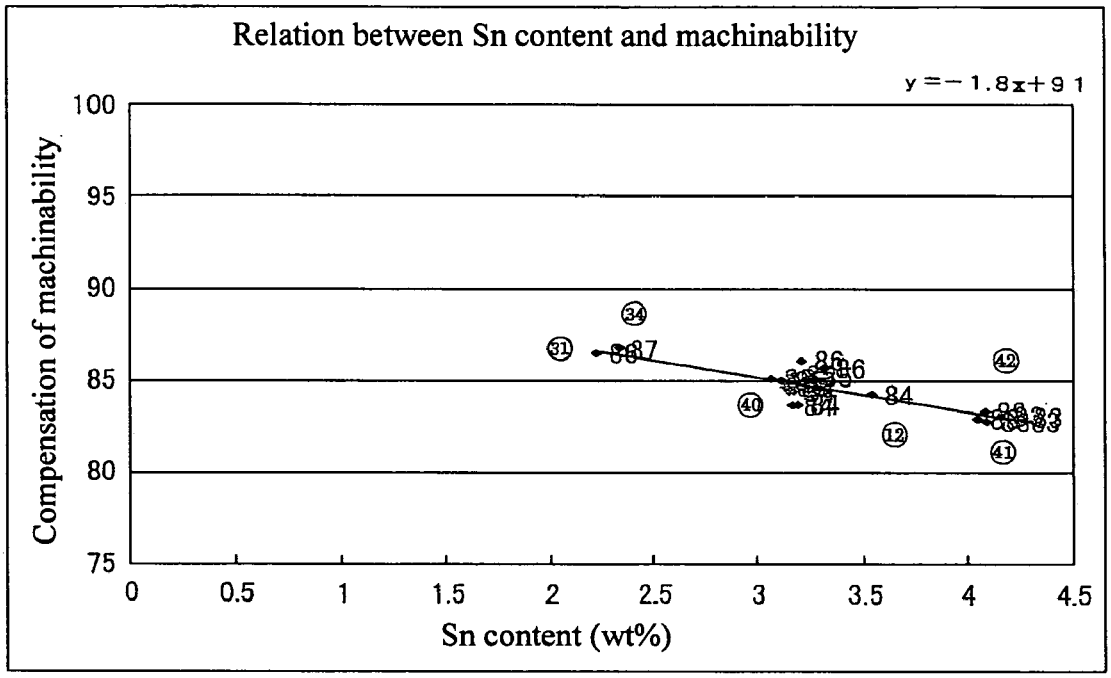
FIG. 13 is a graph showing the relation between the Sn content and the machinability found in a tensile test.

Relation Between Sn Content and Machinability:

FIG. 13 is a graph showing the relation between the Sn content and the machinability found in the machinability test. It is clear from this graph that the machinability is affected at a ratio of −1.8Sn (formula m).

This negative coefficient −1.8 indicates that the machinability is lowered linearly within the range of practical contents of components.

(Tensile Test)

Figure 7:
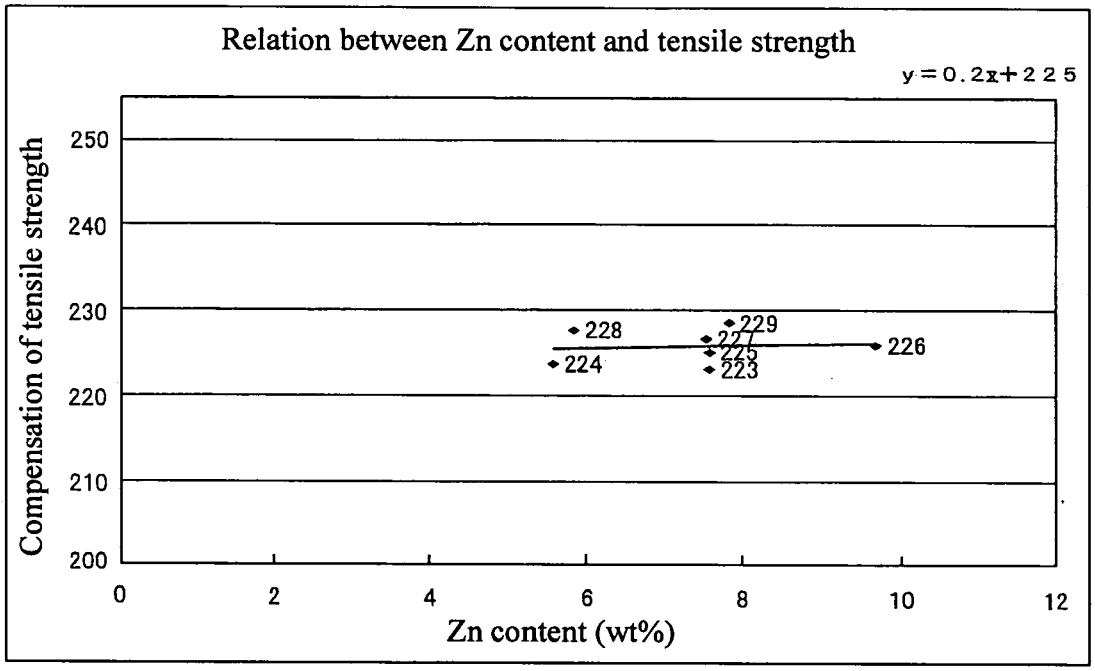
FIG. 7 is a graph showing the relation between the Zn content and the tensile strength found in a tensile test.

Relation Among Zn Content, Tensile Strength and Elongation:

FIG. 7 is a graph showing the relation between the Zn content and the tensile strength found in the tensile test. It is clear from this graph that a variation of the Zn content to about 6% to 10% has substantially no influence on the tensile strength. The relational expression A of the tensile strength which will be described more specifically herein below has paid no consideration to the influence of the Zn content.

Figure 8:
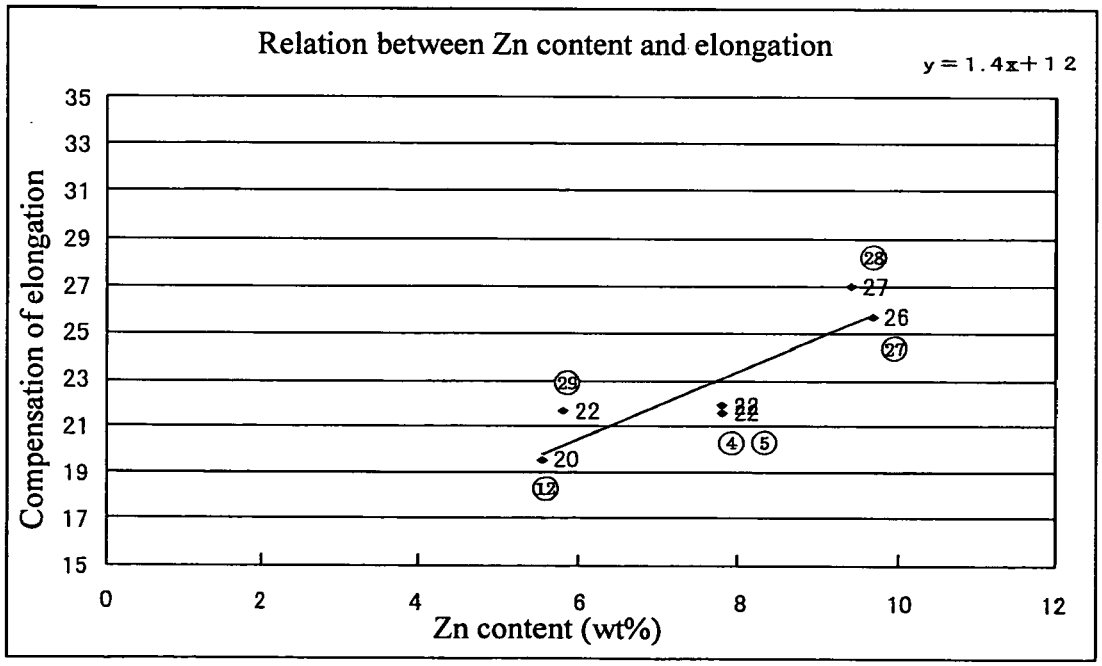
FIG. 8 is a graph showing the relation between the Zn content and the elongation found in a tensile test.

FIG. 8 is a graph showing the relation between the Zn content and the elongation found in the tensile test. It is clear from this graph that the elongation tends to be improved at a ratio of 1.4Zn (formula g) in accordance as the Zn content is increased.

(Machinability Test)

Figure 14:
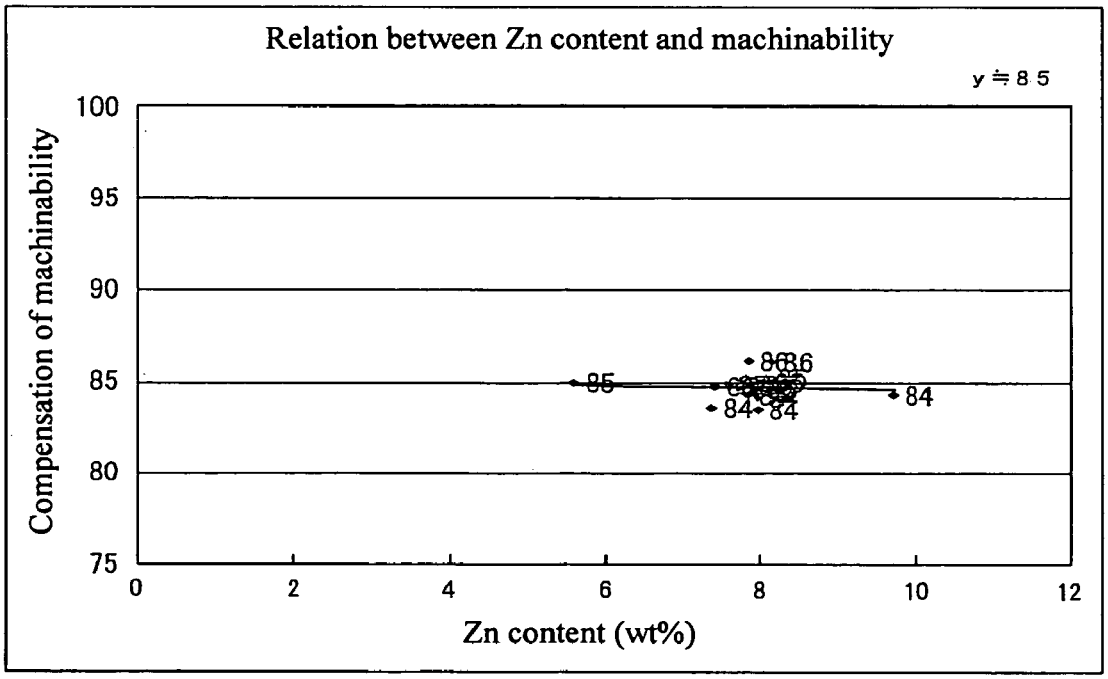
FIG. 14 is a graph showing the relation between the Zn content and the machinability found in a tensile test.

Relation Between Zn Content and Machinability:

FIG. 14 is a graph showing the relation between the Zn content and the machinability found in the machinability test. It may well be said that absolutely no influence exists in the practical range (5.0 to 10.0 wt %) as shown in the graph.

(Tensile Test)

Figure 9:
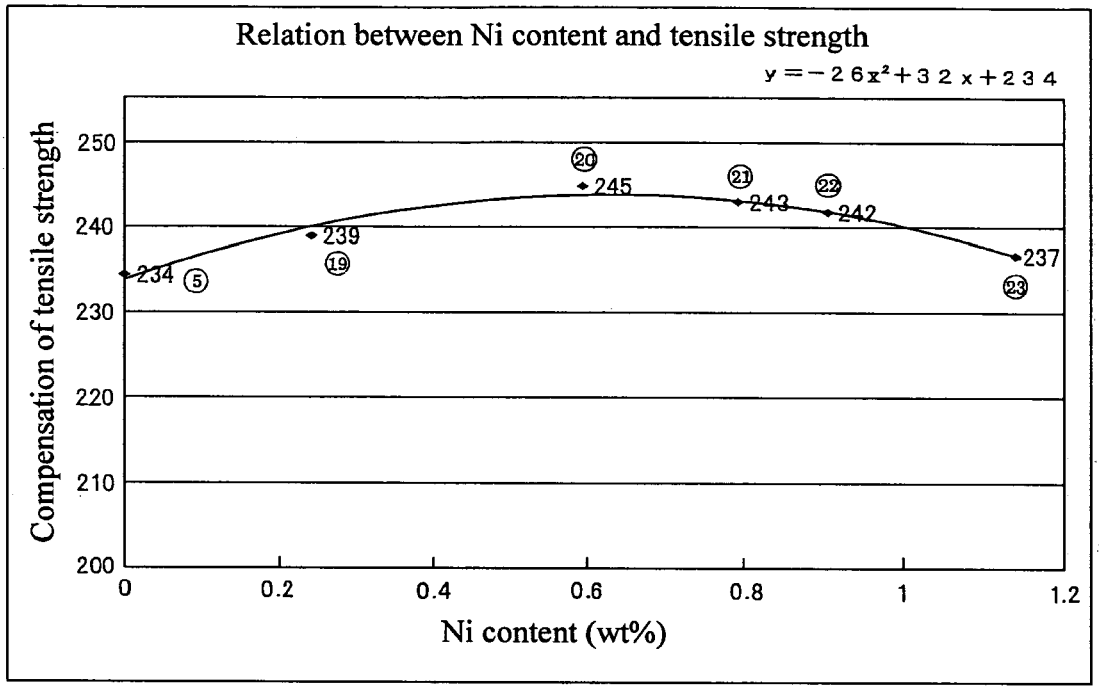
FIG. 9 is a graph showing the relation between the Ni content and the tensile strength found in a tensile test.

Relation Among Ni Content, Tensile Strength and Elongation:

FIG. 9 is a graph showing the relation between the Ni content and the tensile strength found in the tensile test. It is clear from this graph that the influence exerted by the Ni content on the tensile strength may be expressed as $-26Ni^2+32Ni$ (formula h).

FIG. 10 is a graph showing the relation between the Ni content and the elongation found in the tensile test. It is clear from this graph that the influence exerted by the Ni content on the elongation may be expressed as $-7.8Ni^2+11.6Ni$ (formula i). The elongation has a peak similarly to the tensile strength and the Ni content for this peak is about 0.75 wt %.

The following relational expressions A to C (characteristic equations) have been obtained based on the experimental values.

By substituting the values of the individual components for the relevant letter symbols of the relational expressions, it is made possible to comprehend the characteristic properties of the materials on the mass production level without performing an experiment and obtain a copper-based alloy satisfying the specifications of JIS.

In re relational expression A of tensile strength:

$$-3.6Sn^2+32Sn-13Bi-30(Se-0.2)-26Ni^2+32Ni+(185\pm20)>195.$$

This expression has been derived from the sum of formula a+formula c+formula e+formula h, and Ni=0 may be taken for granted. The numeral 185 is a compensation constant derived from the found value and the numeral ±20 is a constant for absorbing the productional error.

By using this expression, it is made possible to predict the found value of the tensile strength by calculation without adjusting the values of the individual components and performing an experiment on each occasion.

Incidentally, according to this expression, the influence of the Se content on the tensile strength is about twice that of the Bi content.

In re relational expression B of elongation:

$$1.4Zn-3.3Sn^2+26Sn-8Bi-7(Se-0.2)-7.8Ni^2+11.6Ni-(23\pm3)>15$$

This expression has been derived from the sum of formula b+formula d+formula f+formula g+formula i, and Ni=0 may be taken for granted. The numeral −23 is a compensation constant obtained based on the found value and the numeral ±3 is a constant for absorbing the productional error. The right side 15 is the lower limit value of the specification of CAC 406 according to JIS. Satisfaction of the rational expression B satisfies the value of specification of the CAC406 according to JIS.

Since the coefficients of Se and Bi are −7 and −8 respectively, the influences exerted by these elements on the elongation are nearly equal. This inclination is different from that of the influences exerted on the tensile strength.

In re relational expression C of machinability:

$$-1.8Sn+10Bi+6Se+(79\pm2)>80$$

This expression has been derived from the sum of formula j+formula k+formula m, and it assumes the form of a three-dimensional linear formula using Sn, Bi and Se as parameters.

The influence exerted by Zn on machinability is omitted from the expression because FIG. 14 supports an inference that absolutely no influence occurs in the practical range (5.0 to 10.0 wt %).

The numeral 79 is a compensation constant derived from the found value and the numeral ±2 which takes into consideration the influence exerted by the productional error on the test results is a numerical value for absorbing the error. The constant 80 on the right side is an empirical value derived from the actual result of processing on the mass-production level. That is, this numerical value signifies that by comparing the relevant leadless material and the CAC406 and enabling the leadless material to acquire the machinability of about 80%, it is made possible to work this leadless material under the same cutting conditions as the CAC406.

The influences exerted by the individual components on the machinability, therefore, are as follows.

Bi exerts its influence at a ratio of 10Bi (formula j) on the machinability as shown in FIG. 11.

Se exerts its influence at a ratio of 6Se (formula k) on the machinability as shown in FIG. 12.

Sn exerets its influence at a ratio of −1.8Sn (formula m) on the machinability as shown in FIG. 13. This negative coefficient −1.8 allows an inference that the machinability is degraded linearly within the practical ranges of the components of the material.

(Castability Test)

Now, the castability of the copper-based alloy contemplated by this invention will be analyzed below.

Since the bronze casting has a wide range of solidifying temperature, it is in the mode of mushy-type solidification and induces the occurrence of minute shrinkage cavities in the dendrite voids. As a result, the shrinkage cavities are liable to seriously deteriorate the pressure resisting property of the casting (castability). Also in the bronze, the element Pb fulfills the role of coalescing in the dendrite voids and filling up the minute shrinkage cavities.

The alloy of this invention that contains no Pb compensates this role of Pb by containing Bi and Se. The influences of the containment of Bi and Se and their contents on the pressure resisting property of the casting have not been appreciably elucidated to date. Thus, the possibility of containing Bi and Se in unduly large amounts in the raw material and consequently boosting the cost of material and degrading the mechanical properties of the produced casting is undeniable.

The influences that Bi and Se have on the castability of a casting will be surveyed here to decide the optimum amounts of Bi and Se to be used in the formula and, at the same time, clarify the significance of the containment of Se.

The bronze alloy is liable to generate fine shrinkage cavities inside the casting as already pointed out above. This trend gains in prominence particularly in the part of the casting having a large wall thickness that is cooled gradually. This phenomenon is called a mass effect. For the purpose of evaluating the degree of this mass effect, a stepped test piece of casting was prepared, cut and subjected to a visible dye penetrant testing. The amounts of non-solid solutions (Bi phase and Se—Zn phase) were also examined to determine their volume ratio.

First, the method of performing the visible dye penetrant testing and the results of the test will be described below.

Figure 15:
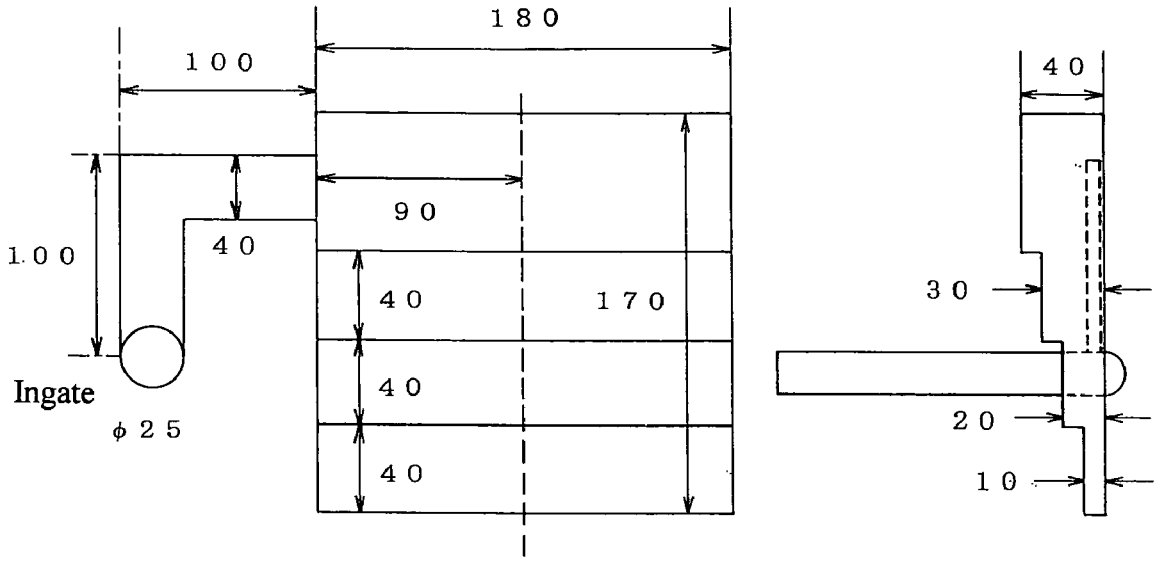
FIG. 15 is an explanatory diagram illustrating a procedure for the casting of a stepped cast test piece.

FIG. 15 depicts a procedure for casting a stepped casting. The procedure for casting the stepped casting generally requires a sprue runner to be fitted with a riser measuring 70 mm in diameter and 120 mm in length. In the present examination, the riser was excluded positively. This omission emanated from a consideration paid to the actual production of the bronze casting. In the case of the actual production, the attachment of an effective riser is difficult because of problems, such as the number of risers to be attached to one frame of mold, the complexity of the shape of a casting and the yield.

As regards the conditions for casting a stepped test piece of casting, the fusion was carried out in a 15-kg high frequency experimental furnace, the amount of fusion was 12 kg, the casting temperature was 1180° C., the casting time was 7 seconds, the mold was a $CO_2$ mold and the deacidification treatment was effected by addition of 270 ppm of P.

Incidentally, the visible dye penetrant testing is a test for determining the presence or absence of a casting defect by spraying a penetrant liquid on a cut face of the test piece, allowing the wet face to stand at rest for 10 minutes, subsequently wiping the penetrant liquid off the cut face, further spraying a developing liquid and rating the red display which floats to the cut face.

Table 6 shows the contents of chemical components in the individual samples used for the test.

TABLE 6

| Sample | Contents of chemical components (unit: wt %, providing that P stands for ppm) | | | | | | |
|---|---|---|---|---|---|---|---|
| No. | Cu | Zn | Sn | Bi | Se | Pb | P |
| 1 | 88.2 | 8.03 | 3.75 | 0.00 | 0.00 | <0.001 | 242 |
| 2 | 88.0 | 7.93 | 3.72 | 0.40 | 0.00 | <0.001 | 261 |
| 3 | 87.9 | 7.83 | 3.68 | 0.60 | 0.00 | <0.001 | 261 |
| 4 | 87.9 | 7.74 | 3.62 | 0.76 | 0.00 | <0.001 | 259 |
| 5 | 87.1 | 8.05 | 3.73 | 1.11 | 0.00 | <0.001 | 253 |
| 6 | 86.5 | 7.94 | 3.76 | 1.78 | 0.00 | <0.001 | 271 |
| 7 | 85.6 | 7.87 | 3.84 | 2.72 | 0.00 | <0.001 | 292 |
| 8 | 87.9 | 7.79 | 3.84 | 0.43 | 0.08 | <0.001 | 246 |
| 9 | 87.8 | 7.80 | 3.70 | 0.60 | 0.07 | <0.001 | 241 |
| 10 | 87.3 | 8.08 | 3.76 | 0.81 | 0.08 | <0.001 | 252 |
| 11 | 87.5 | 8.07 | 3.85 | 0.40 | 0.18 | <0.001 | 268 |
| 12 | 87.7 | 7.88 | 3.71 | 0.59 | 0.17 | <0.001 | 233 |
| 13 | 87.1 | 8.05 | 3.78 | 0.81 | 0.16 | <0.001 | 266 |
| 14 | 87.1 | 7.83 | 3.75 | 1.10 | 0.15 | <0.001 | 270 |

Table 7 shows the results of the visible dye penetrant testing performed on the individual samples.

Figure 16:
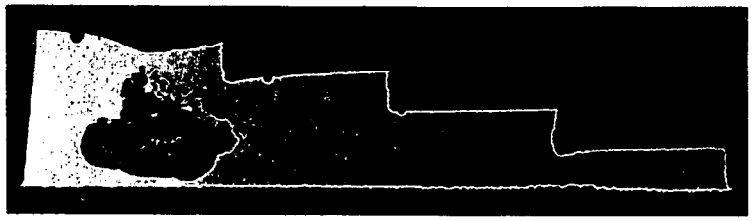
FIG. 16 is a photograph showing the results (No. 1 to No. 7) of the visible dye penetrant testing.
Figure 16:
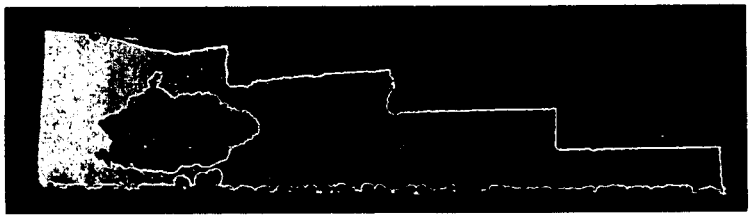
Figure 16:
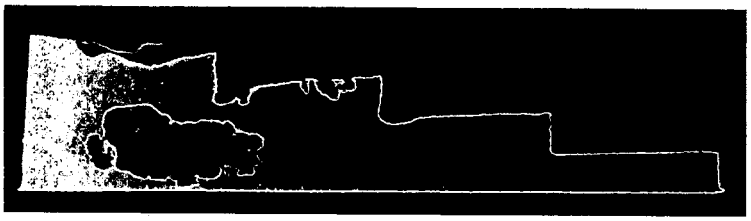
Figure 16:
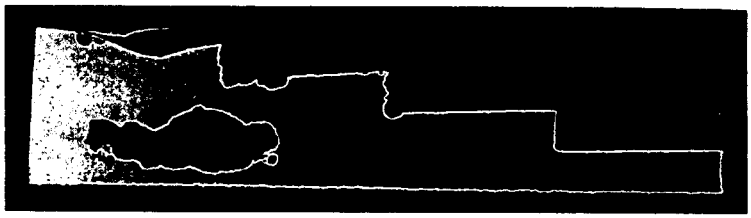
Figure 16:
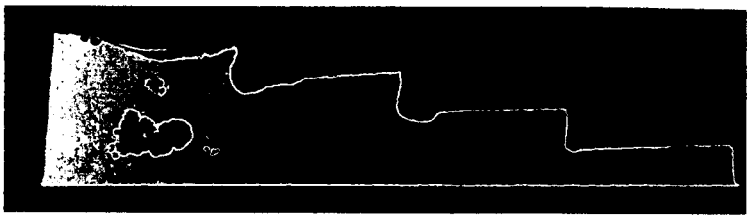
Figure 16:
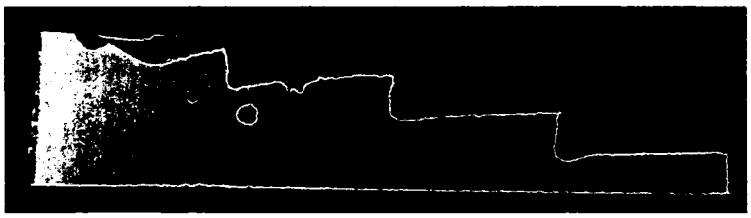
Figure 16:
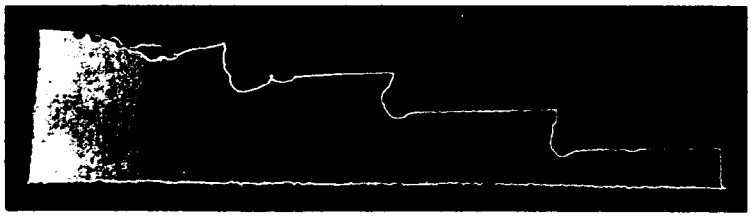
Figure 17:
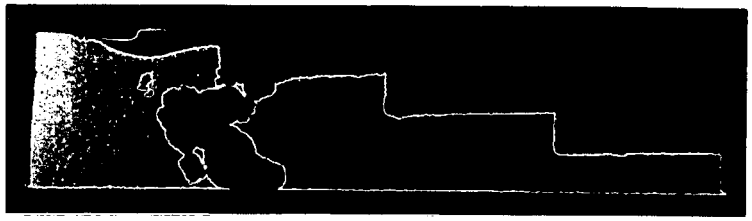
FIG. 17 is a photograph showing the results (No. 8 to No. 14) of the visible dye penetrant testing.
Figure 17:
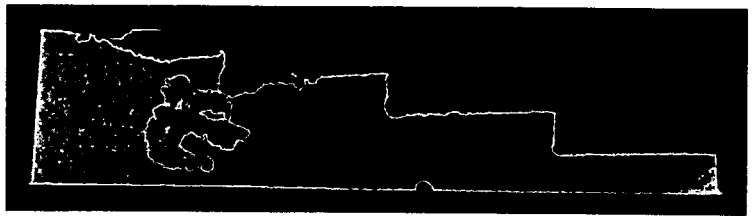
Figure 17:
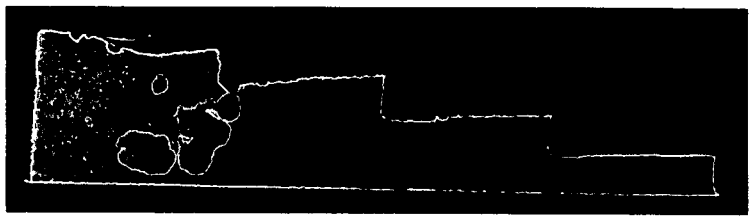
Figure 17:
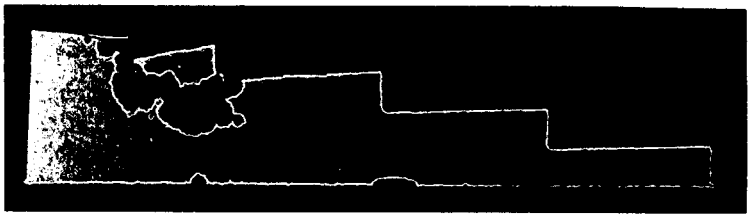
Figure 17:
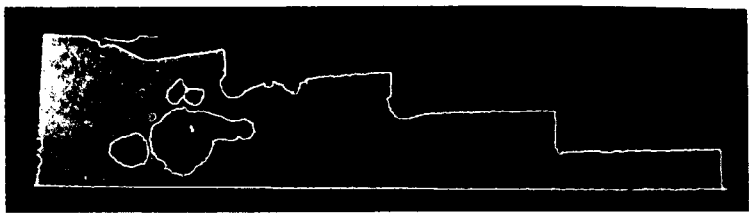
Figure 17:
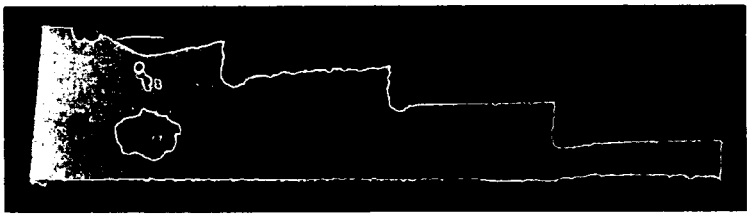
Figure 17:
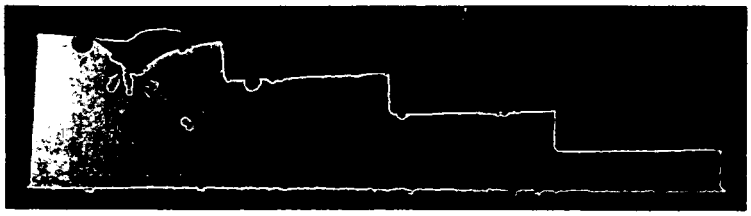

FIG. 16 and FIG. 17 are photographs showing the results of the visible dye penetrant testing. The positions displayed in red show the presence of a casting defect.

As the result of the visible dye penetrant testing, the sample Nos. 6, 7 and 14 were found acceptable. The acceptance was defined as possessing the same castability as the CAC406 (JIS), the hitherto standard material, and permitting production by the same procedure of casting (O). The sample Nos. 5 and 13 were found acceptable (Δ) on the belief that they could be coped with the same procedure of casting as the CAC406. Some, if not all, products had a defect, depending on the shape of a product or the conditions of casting. They seem to require more or less alteration of the casting conditions and the procedure of casting. The other samples were found rejectable (X). Even the samples that were found rejectable would be made to afford good castings by altering the procedure of casting, for example. Inevitably, this alteration would incur extra cost and labor.

TABLE 7

| Sample No. | Bi content wt % | Se content wt % | Bi phase vol % | Se—Zn phase vol % | Actually measured amount of non-solid solution substance, vol % | Theoretical amount of non-solid solution vol % | Result of visible dye penetrant testing |
|---|---|---|---|---|---|---|---|
| 1 | 0.00 | 0.00 | 0.00 | — | 0.00 | 0.00 | X |
| 2 | 0.40 | 0.00 | 0.35 | — | 0.35 | 0.37 | X |
| 3 | 0.60 | 0.00 | 0.53 | — | 0.53 | 0.56 | X |
| 4 | 0.76 | 0.00 | 0.95 | — | 0.95 | 0.71 | X |
| 5 | 1.11 | 0.00 | 1.07 | — | 1.07 | 1.03 | Δ |
| 6 | 1.78 | 0.00 | 1.35 | — | 1.35 | 1.65 | ○ |
| 7 | 2.72 | 0.00 | 2.65 | — | 2.65 | 2.53 | ○ |
| 8 | 0.43 | 0.08 | 0.35 | 0.20 | 0.55 | 0.63 | X |
| 9 | 0.60 | 0.07 | 0.62 | 0.28 | 0.90 | 0.76 | X |
| 10 | 0.81 | 0.08 | 0.87 | 0.32 | 1.19 | 0.98 | X |
| 11 | 0.40 | 0.18 | 0.47 | 0.43 | 0.90 | 0.89 | X |
| 12 | 0.59 | 0.17 | 0.70 | 0.41 | 1.11 | 1.03 | X |
| 13 | 0.81 | 0.16 | 0.72 | 0.48 | 1.20 | 1.21 | Δ |
| 14 | 1.10 | 0.15 | 0.97 | 0.52 | 1.49 | 1.45 | ○ |

Now, the method for determining the volume ratios of the amounts of non-solid solutions (Bi phase and Se—Zn phase) and the results of the determination will be described below.

The term "non-solid solution" refers to an element or a compound that persists along the crystal grain boundary or in the grains without being reduced to a solid solution in the matrix of the alloy. Since this non-solid solution possesses a function of permeating into the microporosities due to the mode of solidification peculiar to the bronze casting and filling up these microporosities, it suppresses the occurrence of casting defects, such as a shrinkage cavity, and enables a casting to secure a pressure resisting property and permits production of a wholesome casting. As concrete examples of the non-solid solution, Bi and Pb mostly existing solely and Se existing in the form of a compound (Bi—Se, Se—Zn, etc.) may be cited.

Figure 18:
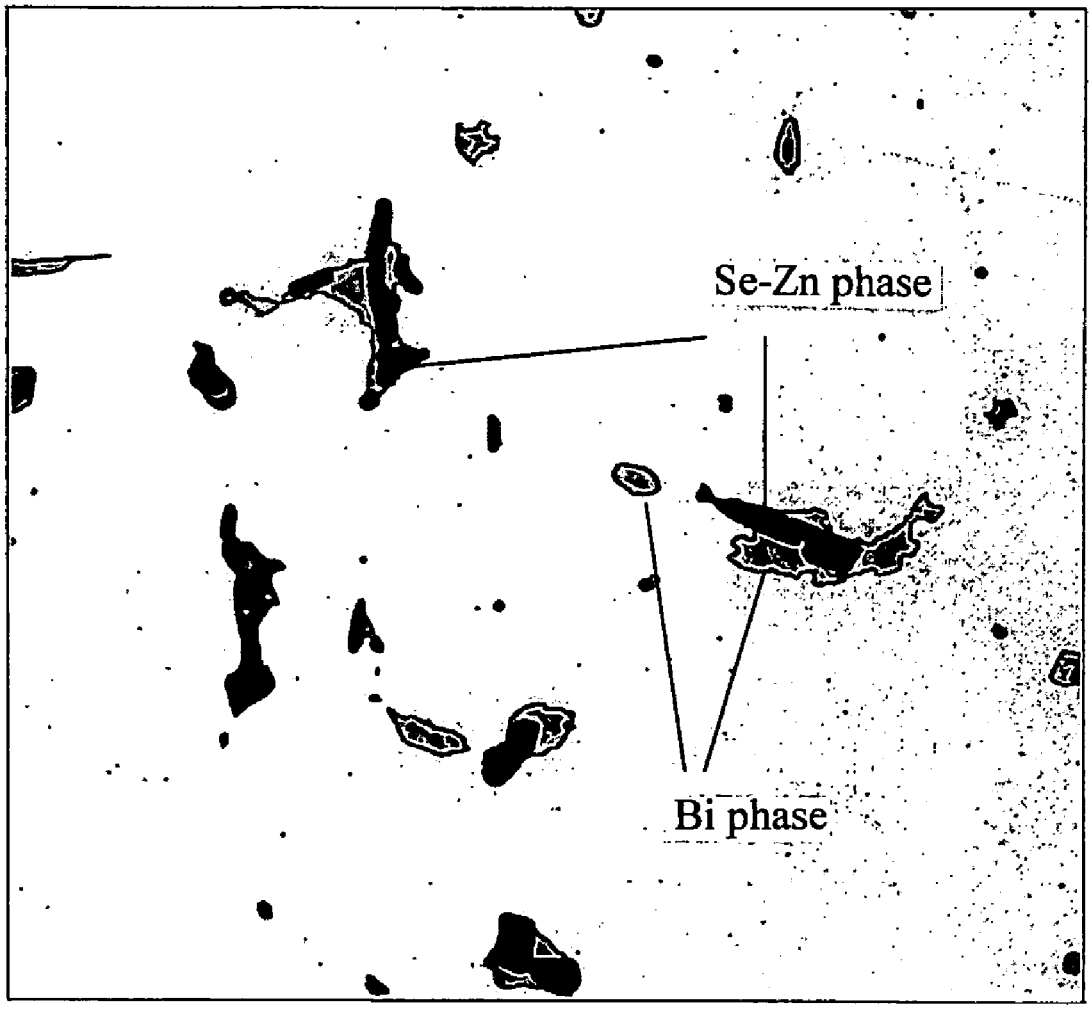
FIG. 18 is a metallographic photograph (400 magnifications) showing a non-solid solution (Bi phase and Se—Zn phase).

FIG. 18 is a photograph (400 magnifications) of the metallography showing a non-solid solutions (Bi phase and Se—Zn phase).

The terms "Bi content" and "Se content" designate the contents of Bi and Se in the alloy as the values of components (unit: wt %) and the terms "amount of Bi phase precipitated" and "amount of Se—Zn phase precipitated" designate the contents of Bi and Se—Zn existing as compounds with Zn in the alloy as the volume ratios (unit: vol %).

The amount of the non-solid solution can be calculated from the composition of the alloy. The procedure for this determination will be shown below.

First, the non-solid solutions that exist in a given alloy are identified in kind by the X-ray analysis. Subsequently, the alloy is subjected to the face analysis (mapping) by the use of EPMA (electron beam microanalyzer) and EDX (energy diffusion type X-ray analyzer). The amounts of the non-solid solutions specified by the X-ray analysis are calculated to determine their ratios of presence. The amounts of the non-solid solutions of the individual samples that were found by the calculation are shown in Table 7. The samples used in this case were test pieces No. 4 for tensile test according to JIS. The cross sections formed in the central parts of the reference marks were subjected to analysis. The term "vol % (volume ratio)" refers to the volume ratio of a given non-solid solution to the whole alloy. The actually measured values of the non-solid solutions shown in the table represent the total values in vol % of the Bi phase and the Se—Zn phase that form the non-solid solutions.

The decrease of the amount of the non-solid solution was found to entail a trend of generating shrinkage cavities. To be more specific, shrinkage cavities occurred when the volume ratio of the non-solid solution to the whole alloy fell short of 1.4 vol % and they occurred in a large number when the volume ratio fell short of 0.95 vol %. The shrinkage cavities decreased when the amount of the non-solid solution exceeded 0.95 vol %.

It is, therefore, advantageous to secure the amount of the non-solid solution in a ratio of 1.0 vol % or more and, for the purpose of enabling the produced alloy to acquire the same castability as the CAC406, in a ratio 1.4 vol % or more.

Now, the upper limit to the amount of the non-solid solution will be described below.

Table 8 shows the results of the calculation of the contents of the components (wt %), the tensile strength (N/mm$^2$), the elongation (%), the machinability (%) and the amount of the non-solid solution (vol %) in the individual samples.

Now, to what ratio Bi and Se functioned to secure the non-solid solution will be described below based on the actual determination and the results of test given in Table 7.

For the purpose of containing Bi alone as an alternative for lead and securing the content of the non-solid solution of 1.4 vol % or more, the Bi content must be 1.5 wt % or more. When Bi and Se are contained as alternatives for lead, by having the Se content in the range of about 0.1 to 0.25 wt %, it is made possible to secure nearly the same amount of the non-solid solution with the Bi content suppressed to 0.7 to 1.2 wt %.

This is because Bi and the like among other non-solid solution generally exist solely in the texture and the Bi content of 1 wt % corresponds to about 0.9 vol % of the non-solid solution content (Bi phase), also because Se mainly exists in the form of an intermetallic compound, such as Se—Zn, and the Se content of 1 wt % corresponds to about 2.9 vol % of the content of non-solid solution (Se—Zn phase) and further because the volume ratio of the content the non-solid solutions in the alloy is secured in a large amount.

Further explanation will be made below using the graphs.

Figure 19:
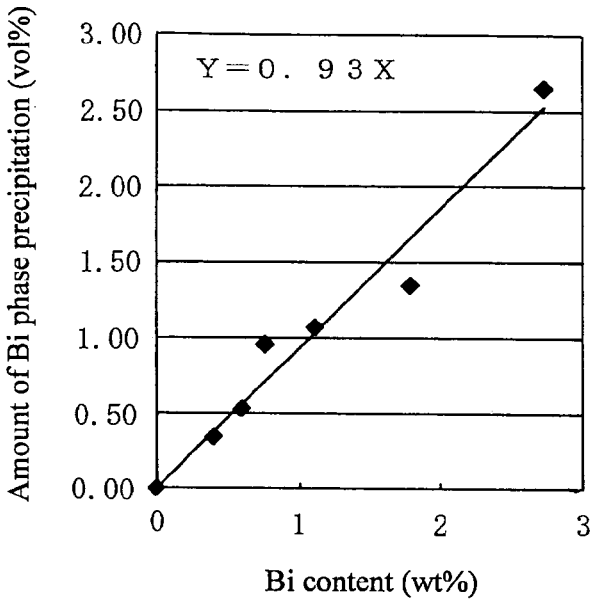
FIG. 19 is a graph showing the relation between the Bi content and the amount of the Bi phase precipitation.
Figure 20:
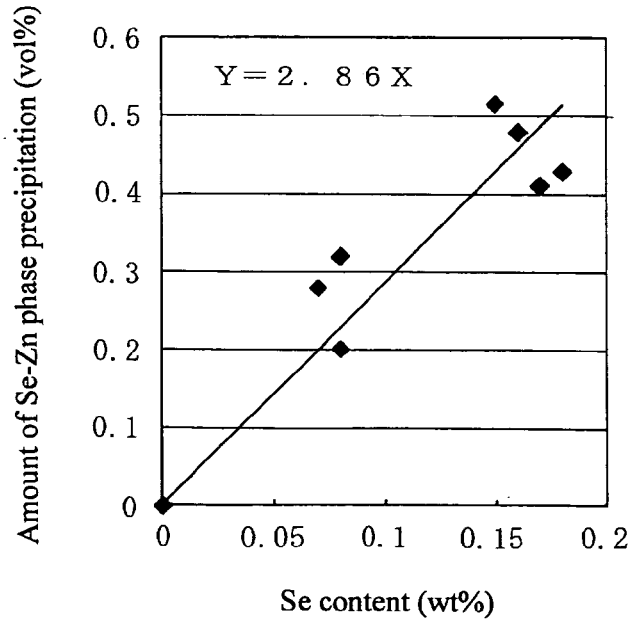
FIG. 20 is a graph showing the Se content and the amount of the Se—Zn phase precipitation.

The relation between the Bi content (wt %) and the amount of the Bi phase precipitated (vol %) is shown in FIG. 19 and the relation between the Se content (wt %) and the amount of the Se—Zn phase precipitated (vol %) is shown in FIG. 20.

TABLE 8

| Sample | Contents of chemical components (unit: wt %) | | | | | | Tensile strength | | | Content of non-solid solution |
|---|---|---|---|---|---|---|---|---|---|---|
| No. | Zn | Sn | Bi | Se | Ni | Cu | N/mm$^2$ | Elongation % | Machinability % | vol % |
| 15 | 10 | 4.4 | 3.16 | 0 | 0 | Balance | 215 | 17 | 103 | 2.93 |
| 16 | 10 | 4.0 | 3.86 | 0 | 0.61 | Balance | 215 | 17 | 109 | 3.58 |
| 17 | 10 | 4.4 | 1.74 | 0.87 | 0 | Balance | 215 | 23 | 96 | 4.10 |
| 18 | 10 | 4.4 | 2.08 | 1.04 | 0.61 | Balance | 215 | 23 | 98 | 4.90 |
| 19 | 10 | 4.4 | 2.14 | 1.07 | 0.61 | Balance | 212 | 23 | 97 | 5.04 |

In Table 8, the sample Nos. 15 and 16 contained Bi solely as an alternative for Pb and the sample Nos. 17 through 19 contained Bi and Se as alternatives for Pb. Incidentally, the sample Nos. 17 through 19 each added Se as a mother alloy for Bi—Se. The mother alloy of Bi—Se had a composition of Bi:Se=2:1. Bi, therefore, was added in an amount twice the amount of Se when Se was added.

The sample Nos. 17 through No. 19 each contained Sn in the amount of 4.4 wt % contributing to the maximization of the tensile strength of the alloy.

The sample Nos. 18 and No. 19 each contained Ni in the amount of 0.61 wt % contributing to the maximization of the tensile strength of the alloy to exalt the strength of the alloy and add to the content of Bi—Se.

It was demonstrated that when the content of the non-solid solution exceeded 4.90 vol %, the tensile strength would fall short of 215 N/mm$^2$ which took consideration of the productional error of +20 to the standard value 195 N/mm$^2$ of the CAC 406.

Thus, it was commendable to set 4.90 vol % as the upper limit and 1.0 vol % as the lower limit for the content of the non-solid solution which was capable of minimizing the Bi content and maximizing the Se content, securing machinability, wholesomeness of a casting and mechanical properties.

From the regression line in the graph of FIG. 19, it is noted that the Bi phase accounts for a volume 0.93 times the Bi content (wt %).

It is noted from the regression line in the graph shown in FIG. 20, the Se—Zn phase accounts for a volume 2.86 times the Se content (wt %).

Since the Se has a light specific gravity (as compared with Bi) and since it forms an intermetallic compound with Zn, the amount of the non-solid solution (Se—Zn phase) is three times the Bi content.

Thus, by having Se contained, it is made possible to suppress the Bi content, suppress the total content of the alternative components for Pb which are rare elements, lower the cost of the material, secure the content of non-solid solution effectively, suppress the occurrence of a casting defect and obtain a leadless copper alloy excelling in pressure resistance.

The theoretical content of the non-solid solution shown in Table 7 was obtained by substituting the Bi content (wt %) to the linear regression formula Y=0.93X obtained in the graph shown in FIG. 19 and substituting the Se content (wt %) to the linear regression formula Y=2.86X obtained in the graph shown in FIG. 20 and adding the values consequently obtained.

That is, the theoretical content of the non-solid solution is represented by the following formula.

$$\text{Theoretical content of non-solid solution (vol \%)} = 0.93\text{Bi (wt \%)} + 2.86\text{Se (wt \%)}$$

While some, if not all, samples reveal some divergence between the actually determined values and the theoretical values of the content of the non-solid solution, they are approximated relatively correctly as shown in FIG. 7. By substituting the values of the individual components to the theoretical formula, it is made possible to comprehend the content of the non-solid solution on the mass production level without requiring an experiment each time, suppress the occurrence of a casting defect and obtain a leadless copper alloy excellent in resistance to pressure.

INDUSTRIAL APPLICABILITY

The copper-based alloy contemplated by this invention secures the same machinability as the bronze alloy (CAC406) popularly used hitherto and possesses mechanical properties more than equal to the CAC406. It, therefore, can be used in general plumbing hardware, such as valves, cocks and joints, for which the leadless bronze alloy materials including CAC406 have been mainly used while manifesting the same or higher functions than the CAC406. In this case, the use of additive materials, such as Se and Bi, which are expensive rare elements, can be decreased. Further, since it excels in castability, corrosion resistance, workpiece performance and resistance to pressure and exhibits good flow in a molten state, it fulfills the effect of permitting application to various cast articles of complicated shapes besides the general plumbing hardware.

The invention claimed is:

1. A copper-based alloy consisting of 5.0 to 10.0 wt % of Zn, 2.8 to 5.0 wt % of Sn, 0.4 to 3.0 wt % of Bi, $0<Se\leqq 0.35$ wt %, $0<P<0.5$ wt %, 3.0 wt % or less of Ni, and a balance of Cu and unavoidable impurities.

2. The copper-based alloy according to claim 1, wherein the content of Se is 0.2 wt % or less.

3. The copper-based alloy according to claim 2, wherein the content of Sn is 3.5 to 4.5 wt %.

4. A cast ingot produced using the alloy according to claim 2 and a liquid-contacting part formed of the cast ingot.

5. The copper-based alloy according to claim 1, wherein the content of Sn is 3.5 to 4.5 wt %.

6. A cast ingot produced using the alloy according to claim 5 and a liquid-contacting part formed of the cast ingot.

7. A cast ingot produced using the alloy according to claim 1 and a liquid-contacting part formed of the cast ingot.

8. A copper-based alloy consisting of 5.0 to 10.0 wt % of Zn, 2.8 to 5.0 wt % of Sn, 0.4 to 3.0 wt % of Bi $0<Se<0.35$ wt %, $0<P<0.5$ wt % 3.0 wt % or less of Ni, 1.20 to 4.90 vol % of at least one selected from the group consisting of a non-solid solution substance secured with Bi and a non-solid solution secured with Bi and Se, and a balance of Cu and unavoidabie impurities.

9. The copper-based alloy according to claim 8, wherein the at least one non-solid solution substance is secured with Bi.

10. A cast ingot produced using the alloy according to claim 9 and a liquid-contacting part formed of the cast ingot.

11. The copper-based alloy according to claim 8, wherein the at least one non-solid solution substance is secured with Bi and Se.

12. A cast ingot produced using the alloy according to claim 11 and a liquid-contacting part formed of the cast ingot.

13. A cast ingot produced using the alloy according to claim 8 and a liquid-contacting part formed of the cast ingot.

* * * * *